US006754460B2

(12) United States Patent
Lewis et al.

(10) Patent No.: US 6,754,460 B2
(45) Date of Patent: Jun. 22, 2004

(54) METHOD OF REMANUFACTURING A TONER CARTRIDGE

(75) Inventors: Lawrence Dale Lewis, Sanford, NC (US); Lynton Russell Burchette, Sanford, NC (US); Gary B. Harrison, Cameron, NC (US); Allan P. Weiler, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 98 days.

(21) Appl. No.: 10/091,189

(22) Filed: Mar. 5, 2002

(65) Prior Publication Data

US 2003/0170045 A1 Sep. 11, 2003

(51) Int. Cl.[7] ..... G03G 15/00; G03G 15/08
(52) U.S. Cl. ..... 399/109; 399/113
(58) Field of Search ..... 399/103, 106, 399/109, 113

(56) References Cited

U.S. PATENT DOCUMENTS

| | | | | | |
|---|---|---|---|---|---|
| 5,223,068 | A | | 6/1993 | Baley | 156/250 |
| 5,826,140 | A | | 10/1998 | Zona et al. | 399/106 |
| 5,870,654 | A | * | 2/1999 | Sato et al. | 399/109 |
| 5,878,306 | A | | 3/1999 | Michlin | 399/106 |
| 5,907,747 | A | | 5/1999 | Diener | 399/109 |
| 5,937,238 | A | * | 8/1999 | Tremblay et al. | 399/109 |
| 6,029,031 | A | * | 2/2000 | Yokomori et al. | 399/109 |
| 6,240,605 | B1 | * | 6/2001 | Stevens et al. | 399/106 |
| 6,272,300 | B1 | | 8/2001 | Fujiwara et al. | 399/113 |
| 6,615,008 | B2 | * | 9/2003 | Higeta et al. | 399/109 |

* cited by examiner

*Primary Examiner*—Fred L. Braun
(74) *Attorney, Agent, or Firm*—William L. London

(57) ABSTRACT

A method of remanufacturing a new style toner cartridge which has a toner cartridge/developer roller/waste bin sub assembly covered by a first and second end cap. The method includes removing the first and second end cap using a cutting tool and template, removing the existing seal from the toner hopper, replacing it with a new seal assembly that connects the toner hopper to the developer roller housing, reattaching the waste bin, and then reattaching the end caps with quick disconnect clips or clamps.

27 Claims, 22 Drawing Sheets

METHOD OF REMANUFACTURING A TONER CARTRIDGE

BACKGROUND OF THE INVENTION

This invention relates to the field of remanufacturing toner cartridges for use in electrophotographic devices such as printers, copiers, and facsimile machines. These toner cartridges typically contain a number of components in addition to toner. Remanufacturers of toner cartridges take used toner cartridges, clean them, replace any worn out components, and add new toner. The resulting remanufactured or recycled toner cartridge is then sold, generally at a discount compared to a new cartridge.

Remanufacturers have used a variety of different methods to remanufacture toner cartridges. U.S. Pat. No. 5,223,068 to Raymond Baley discloses one such method of remanufacturing a toner cartridge.

The method of remanufacturing a toner cartridge is dependent upon the original design of the toner cartridge. Some remanufacturers contend that changes in the design of toner cartridges by the original equipment manufacturer (OEM) are done, at least in part, to defeat remanufacturing. Whether this reason for OEM design changes is true or not, it is true that changes in the design of a cartridge by the OEM create new difficulties for remanufacturers. Most of these difficulties center on disassembling the cartridge in a way that allows for fast and economical cleaning, replacing of worn components, and adding new toner.

A recent design change by the OEM in a cartridge called the HP 9000 has a dramatically different design from previous toner cartridges. The HP 9000 is substantially larger, holding much more toner than previous toner cartridge designs. The HP 9000 has end caps that are welded onto the full width of the toner cartridge. The end caps apparently give the cartridge greater strength, and help hold the toner hopper/developer roller housing/waste bin sub assembly. Before the introduction of the HP 9000 most toner cartridges had a toner hopper attached to a developer roller housing, and flexible film seal heat-sealed to the sealing surface of the toner hopper. The toner hopper/seal/developer roller housing assembly in turn was mechanically connected to the waste bin. The mechanical connection to the waste bin was accomplished with the use of one or more pins. The toner hopper was attached to the developer roller housing by ultrasonic welds at the seam between them. These welds were readily accessible from the exterior and could be sawed apart or wedged apart. Once remanufacturers separated the developer roller from the toner hopper, the remanufacturer could easily access the components in the toner hopper and developer roller housing and could easily reseal the toner hopper.

The HP 9000 has a unique construction. It is anticipated that other OEMs will make toner cartridges of similar construction in the future. The toner hopper and developer roller housing are not welded directly together. Instead they are each separately heat sealed to a specialized seal assembly. This seal assembly has an accordion connector that is heat sealed to an intermediate plate. The intermediate plate is ultrasonically welded to the toner hopper, and the opposite end of the accordion seal is heat sealed to the developer roller housing. The accordion pleats are heat sealed together. The toner hopper and the developer roller housing are thus indirectly connected together. The waste bin section of the HP 9000 attaches in the usual manner to this toner hopper/developer roller housing by use of a pin, and a spring connection. The toner hopper and waste bin are then held in a fixed relationship to one another by two rigid end caps that run the entire width of the cartridge and that are welded onto the toner hopper and the waste bin. The developer roller housing floats relative to the waste bin ensuring that the developer roller and OPC drum maintain a proper relationship. Embedded in one of the end caps near the location of the welds are a variety of electrical contacts that provide the necessary voltages to the different components of the toner cartridge.

The use of the end caps coupled with the electrical connection between one of the end caps, and the sub assembly behind them create unique problems for the remanufacturer. First, end caps must be separated in such a way as to not sever the electrical connections hidden inside them. Secondly, the end caps must be removed in such a way as to allow for reattachment of these end caps.

The seal used in the HP 9000 also presents issues of complexity. Rather than simply heat sealing a seal to a toner hopper, the OEM in the HP 9000 heat seals a metallized film to the toner hopper sealing surface. This metallized film in turn has a tail that is attached to the one end of the seal and extends back over the seal to the other side of the cartridge. The end of the tail is threaded onto a spool. That spool is contained within a housing attached to the toner hopper and concealed within one of the end caps. The toner hopper has electrical contacts on the surface of the toner hopper. These toner hopper contacts are designed to be in electrical contact with a pair of conductive traces on the surface of the OEM seal. When the end-user places the cartridge into the printer, the printer senses whether the seal is in place by sensing whether the electrical connection between the contacts are in place. If there is an electrical connection between both sets of contacts, then the printer will cause the spool to wind, removing the seal from over the toner hopper discharge opening and breaking the electrical connection of the first contact, but not the second contact. If the printer does not sense at least the second contact, then it will not print at all. Therefore, any replacement seal must emulate the electrical characteristics of the OEM seal.

Finally, this new construction causes problems in the way the toner hopper and developer roller housing are to be reattached after this assembly. As mentioned above, the OEM heat seals each of these members to an intermediate plate, or an accordion seal. The intermediate plate and accordion seal are destroyed in the process of any separation of the toner hopper from the developer roller housing. In remanufacturing the toner cartridge, it is difficult to maintain the right stack height between the developer roller housing and the toner hopper as well as to firmly adhere the two together.

The present method of remanufacturing as described below solves these and other problems associated with remanufacturing cartridges with construction similar to the HP 9000. This method further facilitates rapid and repeatable remanufacturing of these cartridges.

SUMMARY OF THE INVENTION

The method of remanufacturing toner cartridges with two end caps that run the full width of the toner cartridge is as follows:

First, the end caps of the toner cartridge must be separated from the toner hopper/developer roller housing/waste bin sub assembly. The end caps have been welded onto the sub assembly. The preferred method is to cut the end cap welds deeply enough to separate the end caps, but not so deeply as to damage the end cap electrical contacts. Two templates are used to control location of cutting on these end caps. Cuts are made through the template openings through the welds between the end caps and the toner hopper/developer roller housing/waste bin sub assembly. In the preferred embodiment the first template and second template are clamped together across the toner cartridge and then placed in a frame which allows the cartridge to be rotated during cutting. The first and second templates may be made of plastic, but in the preferred embodiment are made of aluminum. There is a first axle connected to the first template and a second axle connected to the second template. The first and second axle rest on a first and second upright respectively. The first and second uprights together make the frame. In the preferred embodiment, the first and second upright are tall enough to allow the toner cartridge to be completely rotated facilitating cutting of the weld through the template opening. In a preferred embodiment a base connects the first and second upright providing additional stability to the toner cartridge splitter.

The first template has first template openings. The second template has second template openings. These openings correspond to the welded sections of the end caps. In the preferred embodiment, a router, or other rotary cutting tool, is used to cut the end cap welds. The cut locations are controlled by the location of first and second template openings. The depth of cut is controlled by a retractable bit enclosure that exposes the desired amount of cutting but the retractable bit on closure is pressed against the templates at the template openings. The desired depth of cut is necessary to cut the weld on the end caps without damaging the end cap electrical contacts.

After the end cap welds are cut on the toner cartridge splitter, the toner cartridge is removed from the toner cartridge splitter and the end caps are pulled from the toner hopper/developer roller housing/waste bin sub assembly. Some minor cutting or wedging may need to be done to facilitate this removal. If so, a box cutter or pocketknife can be used. The waste bin is separated from the developer roller housing by removing the toner cartridge pin and disassembling the spring. The waste bin may then be cleaned, and any worn components in it may be replaced.

The remaining section of the toner cartridge consists of the toner hopper and developer roller housing together with the seal. These may be separated by sawing them in half, by wedging apart the welds between them or by cutting the accordion seal with a knife. In so separating the toner hopper from the developer roller housing, the seal intermediate plate is loosened, and should be discarded. The old seal itself should be removed and discarded. The seal spool cover should be removed. The spool cover is generally heat tacked or glue tacked on the toner hopper. It may be separated by use of a screwdriver, knife, or other wedging tool. The old seal is removed from the spool, and any traces of the old seal should be cleaned from the toner hopper sealing surface.

Now the new seal may be attached to the toner hopper sealing surface. The tail of the removable seal should be threaded through the spool. The spool cover should be replaced and tacked down. In the preferred embodiment glue is used to reattach the spool cover. It is not important that this attachment result in a tight seal around the spool cover.

The preferred embodiment of the new seal has the following construction which aids in the reconstruction of the toner cartridge. The preferred embodiment of the replacement seal has a first gasket layer with a first side and a second side and the gasket opening. A removable seal layer is attached to the second side of the gasket. The removable seal layer has a first side, a second side, and a first end and a second end with a tail attached to the second end. An electrically conductive trace is attached to the second side of the removable seal layer at the first end. A second gasket layer is attached to the second side of the removable seal layer. The removable seal layer preferably has a two-part construction. A metallized film is attached to the first gasket and a polypropylene ribbon material is attached to the metallized film. The metallized film provides strength to the removable seal while the polypropylene ribbon material can be oriented so that the removable seal preferentially tears in the desired direction. In the preferred embodiment the first side of the first gasket layer has a pressure sensitive adhesive layer attached to it. In use this layer of pressure sensitive adhesive attaches the seal assembly to the toner hopper. The removable seal layer which is attached to the second side of the first gasket layer completely covers the gasket opening. The combination of these two elements seal the toner in the toner hopper. The removable seal layer has a tail at its second end. The tail of the removable seal layer is folded back over the length of the seal toward the first end. This first end of the removable seal layer is placed closest to the seal spool. This end of the tail of the removable seal is threaded onto the spool. On top of the removable seal layer and attached to both the removable seal layer and the first gasket layer is a second gasket layer. The second gasket layer is attached to the removable seal layer, or to the removable seal layer and first gasket layer below. This is on the first side of the second gasket layer. In the preferred embodiment, the second side of the gasket layer is attached to a layer of pressure sensitive adhesive. In use, this pressure sensitive adhesive layer attaches the seal assembly to the developer roller housing. By use of this construction, the seal itself creates the connection between the toner hopper and the developer roller housing.

After replacing the worn components, and replacement of the seal over the toner hopper, the remanufacturer may now add new toner through the toner fill hole by removing the old plug, adding toner and replacing the plug. If necessary, a new plug may be placed in the toner fill hole. After new toner is added, the toner hopper and developer roller housing are reattached. In the preferred embodiment, the reattachment is through use of the seal discussed above. The developer roller housing is attached to adhesive on the second side of the second gasket. Added support for this connection will come through use of the end caps. After the toner hopper and developer roller housing are connected, the waste bin section is reconnected to the developer roller housing by use of a toner cartridge pin and spring. The end caps are now ready to be reattached.

Although the end caps may be glued or welded back into place, in the preferred embodiment, the end caps are replaced in a manner that facilitates easy removal for a second remanufacturing. In the preferred embodiment a series of clips are screwed into the end caps at set locations. These screw clips can then be clamped to the body of the toner hopper/developer roller housing/waste bin sub assembly. Clips without screws may be used, however, screws make for a tighter connection. The screws are also easily removable and reusable. In an alternate embodiment, clips that clip onto discrete locations of the end cap and to the body of the toner hopper/developer roller housing/waste bin sub assembly are used.

BRIEF DESCRIPTION OF THE DRAWINGS

Figure One is a top view of a prior art toner cartridge.

Figure Two is a bottom view of a prior art toner cartridge.

Figure 1:
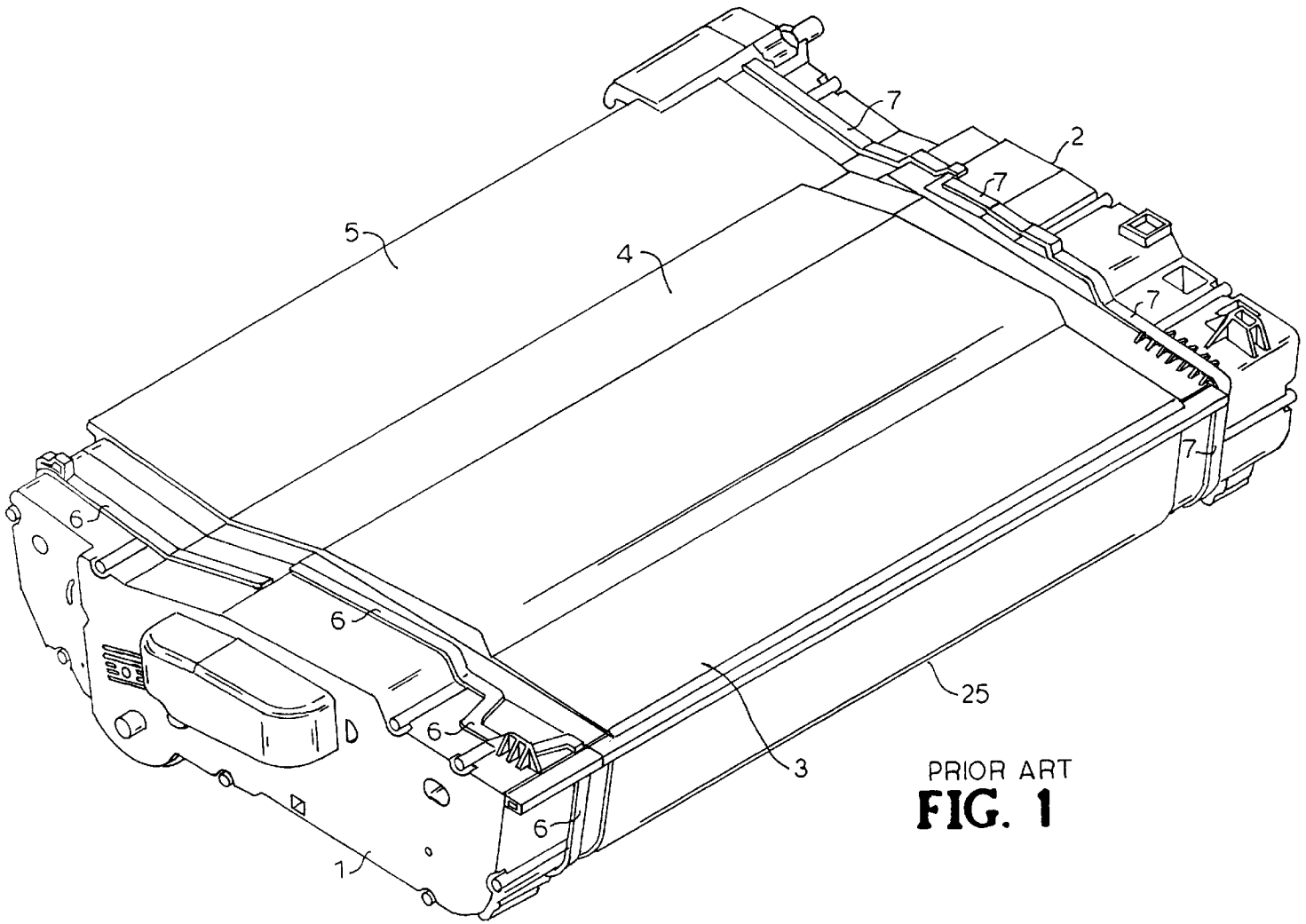
PRIOR ART FIG. 1
Figure 2:
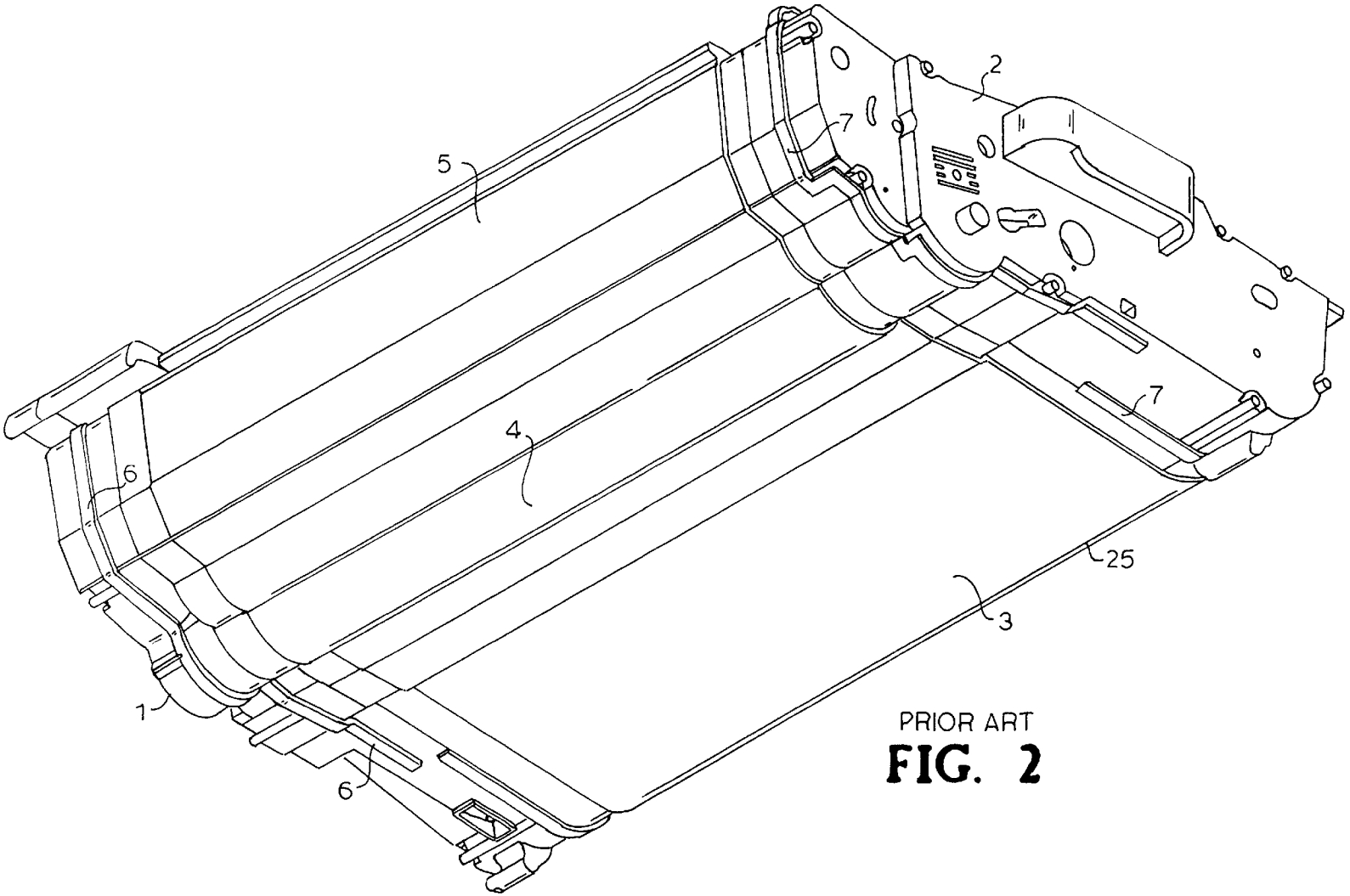
PRIOR ART FIG. 2
Figure 3:
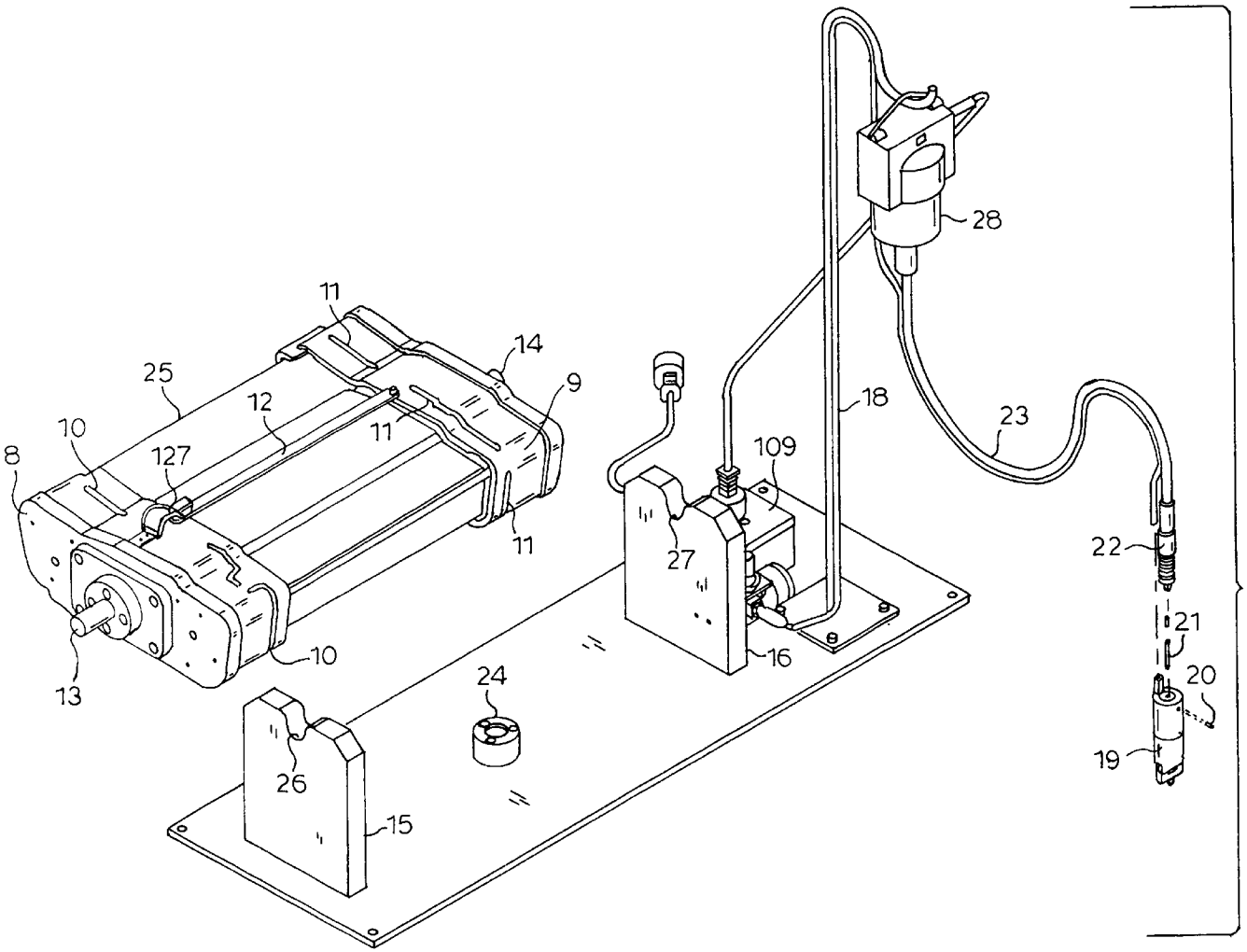
Figure 4:
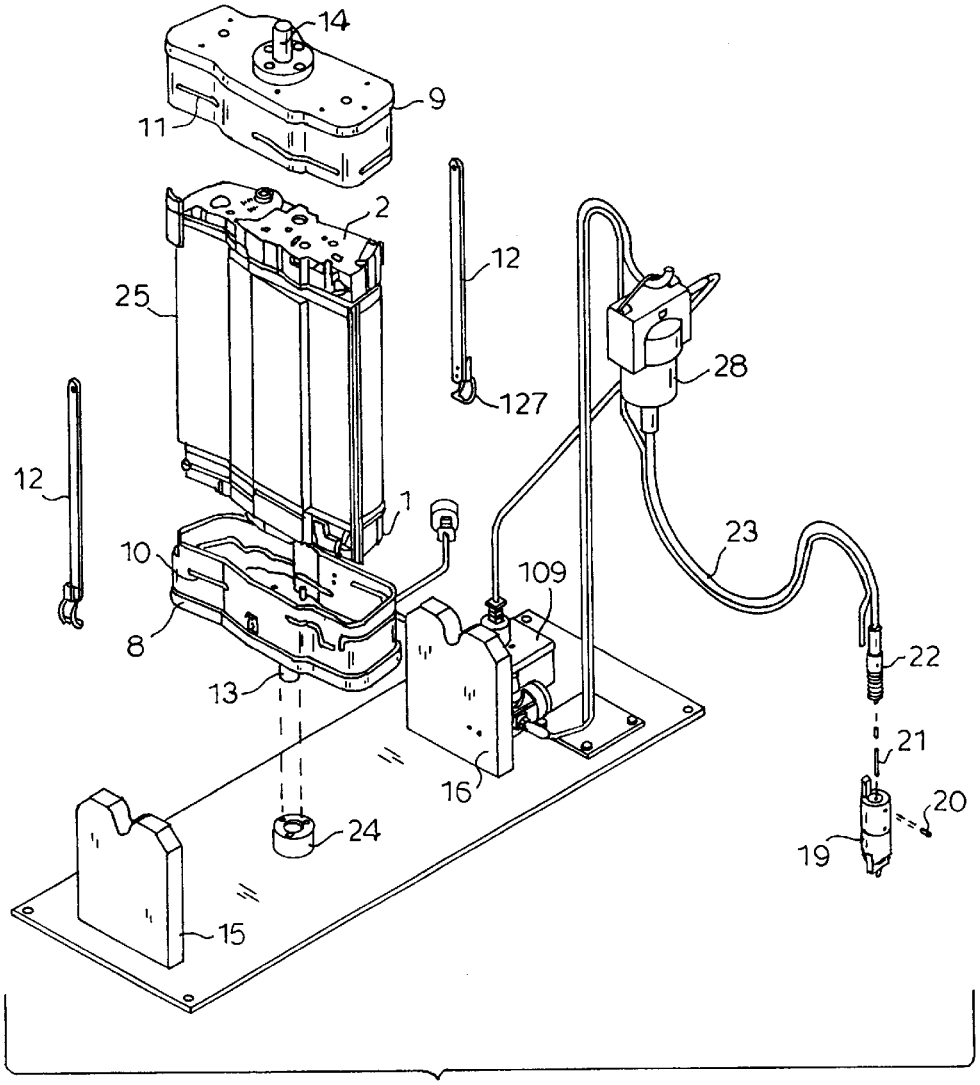
Figure 5:
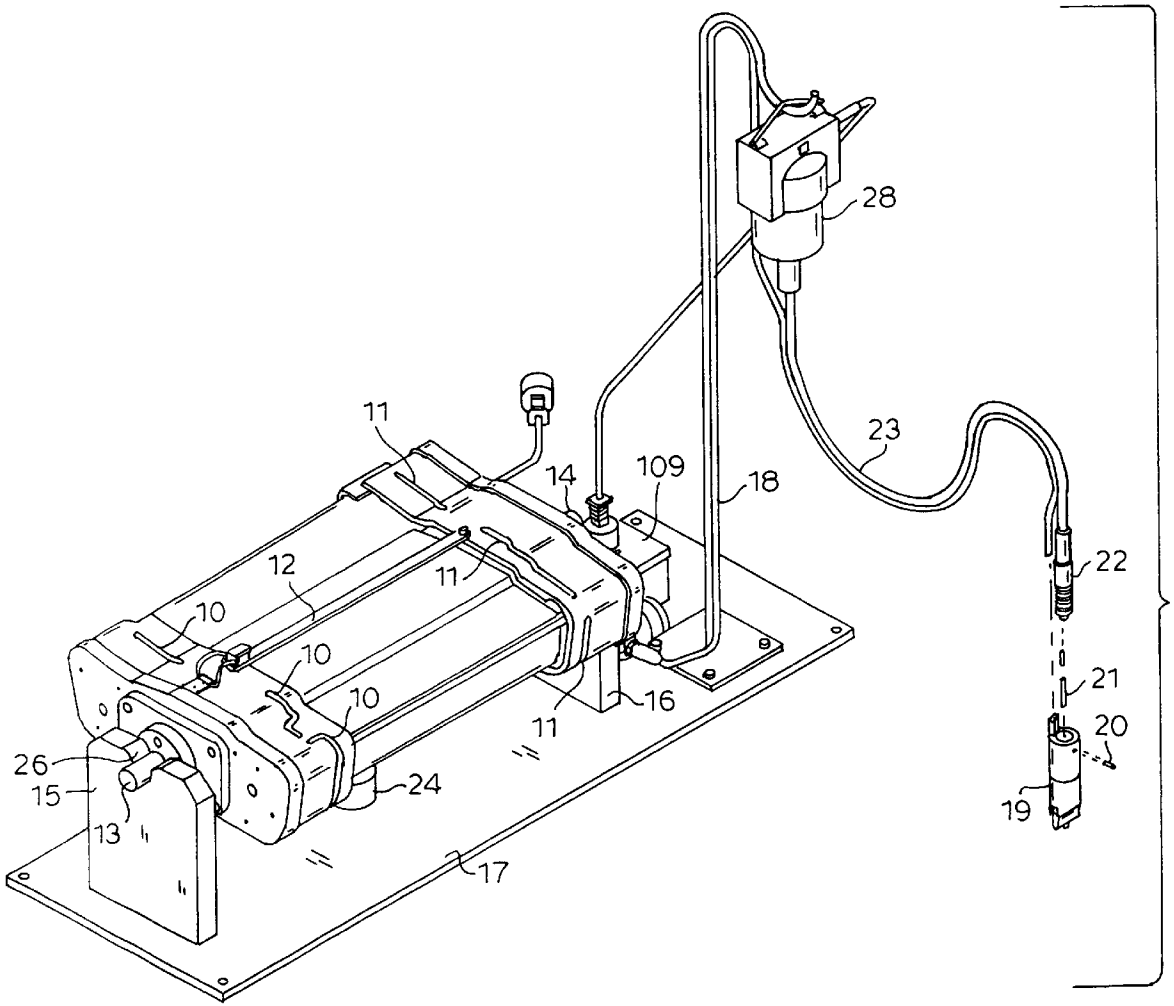
Figure 6:
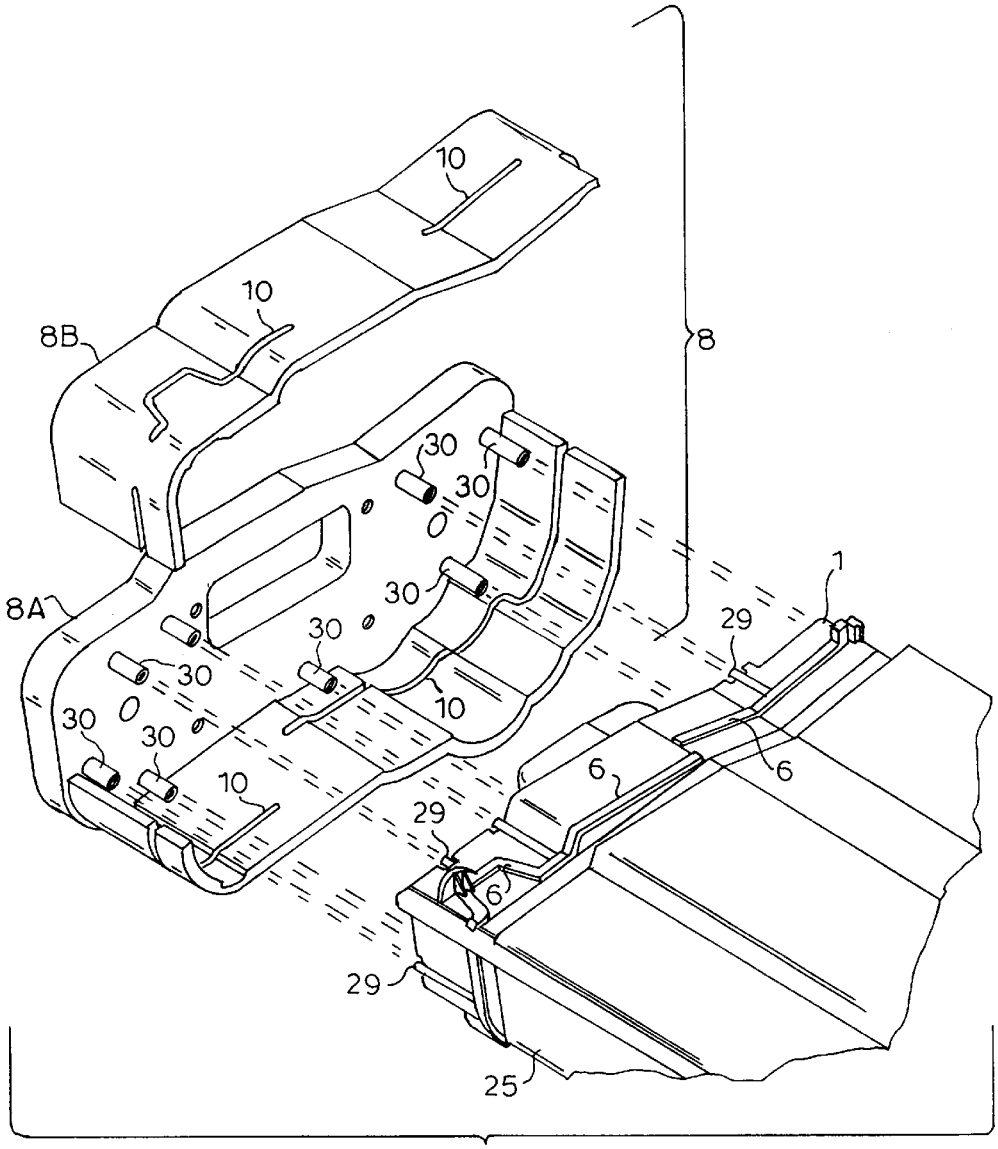
Figure 7:
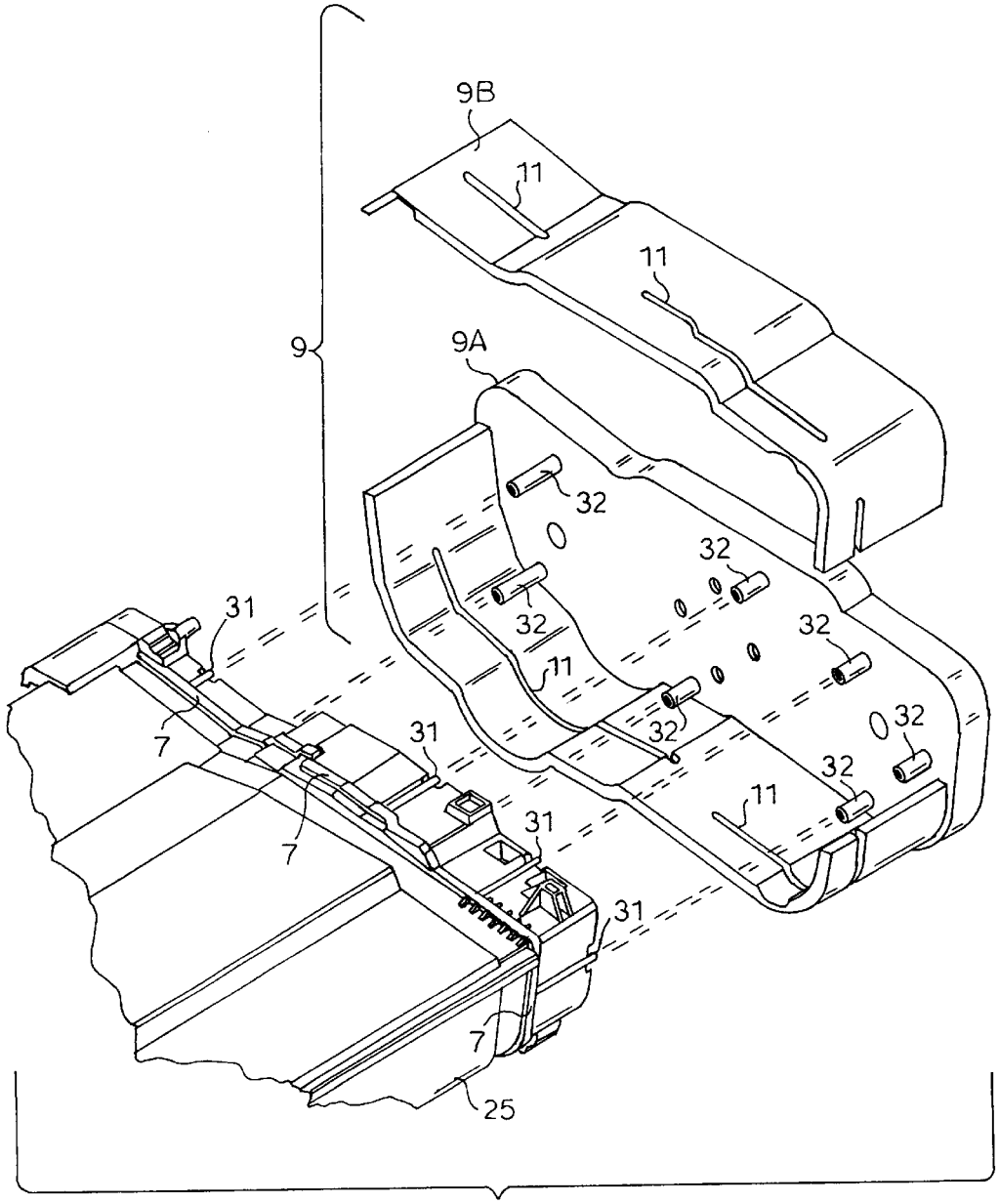
Figure 8:
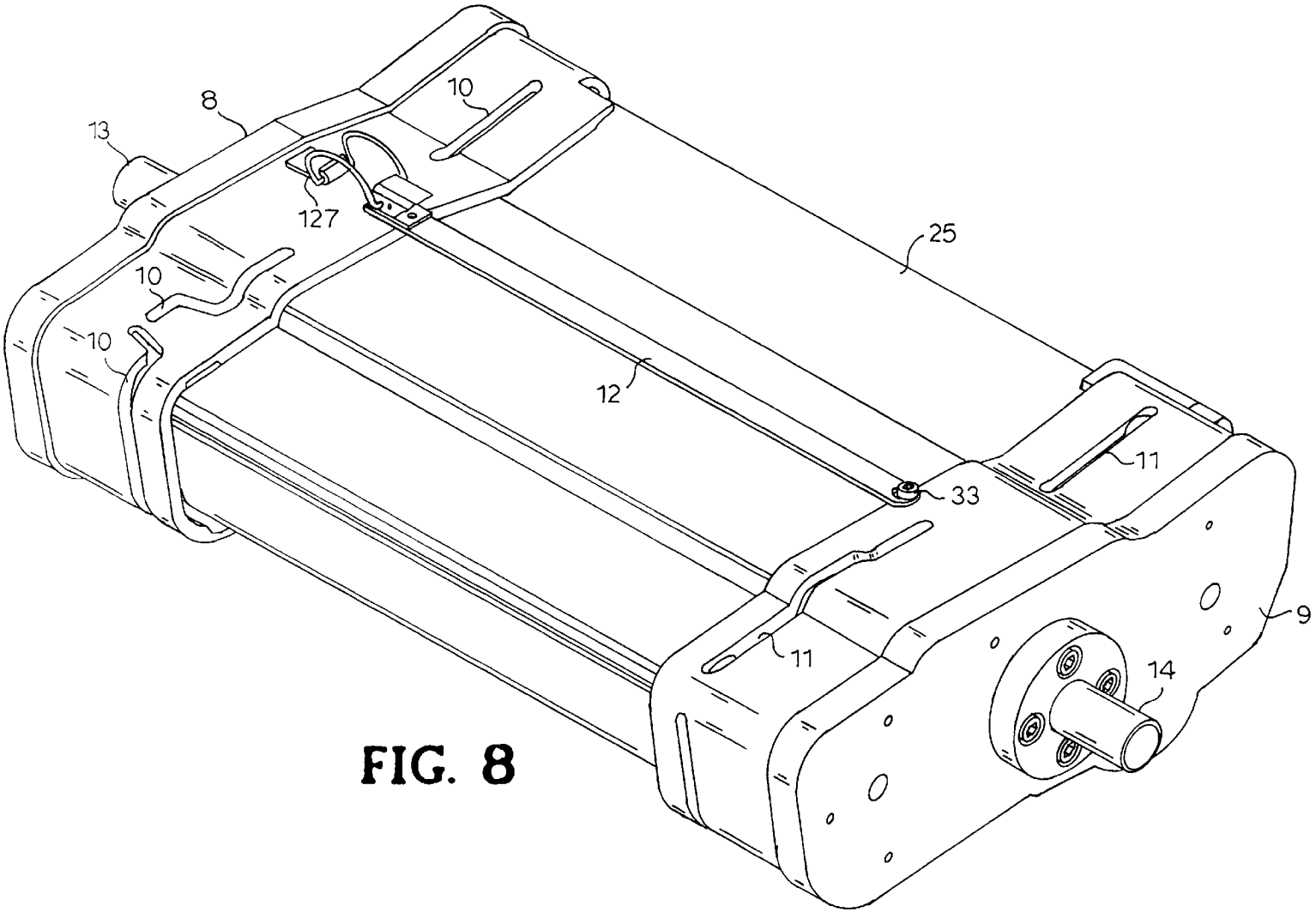
Figure 9:
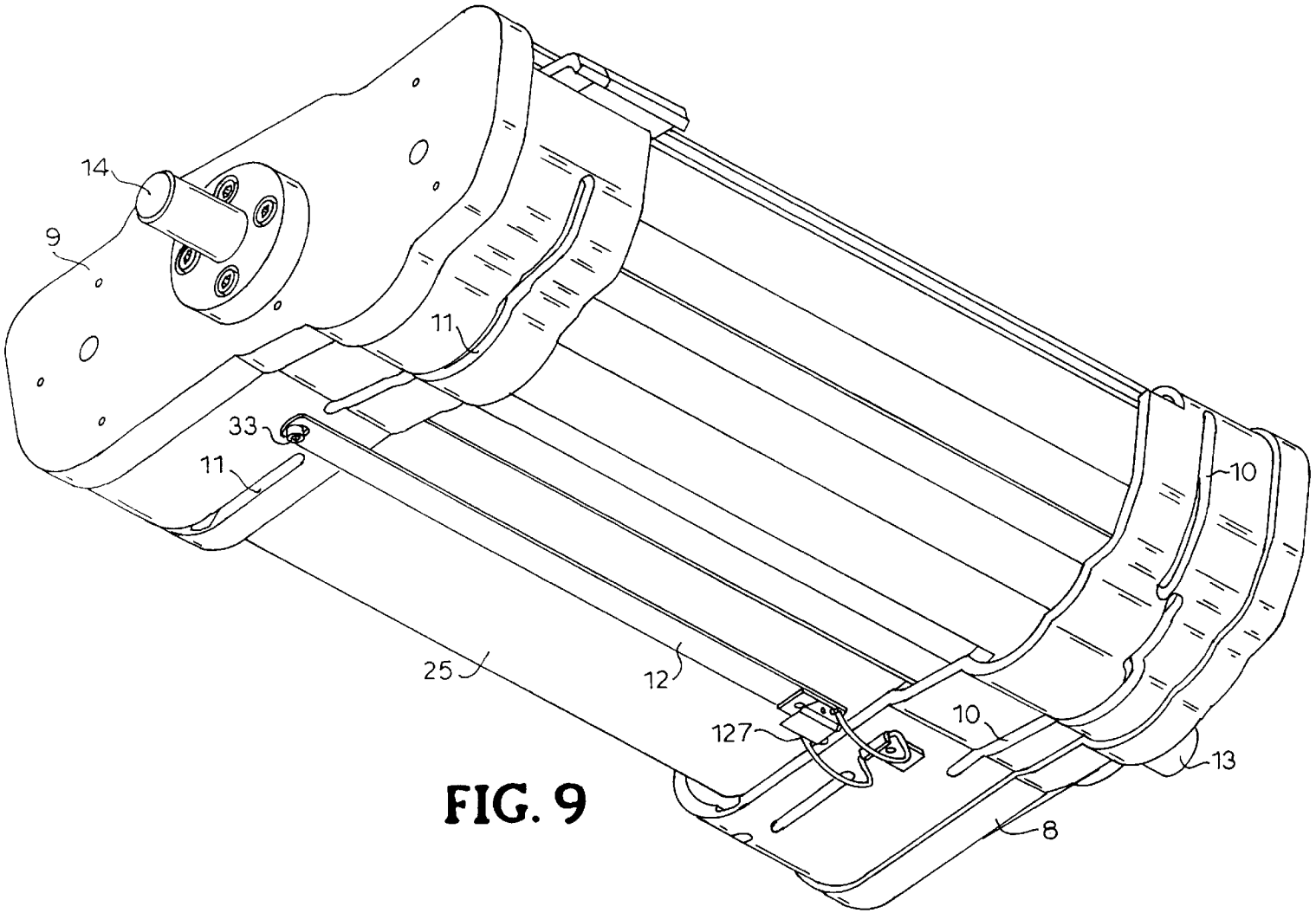
Figure 10:
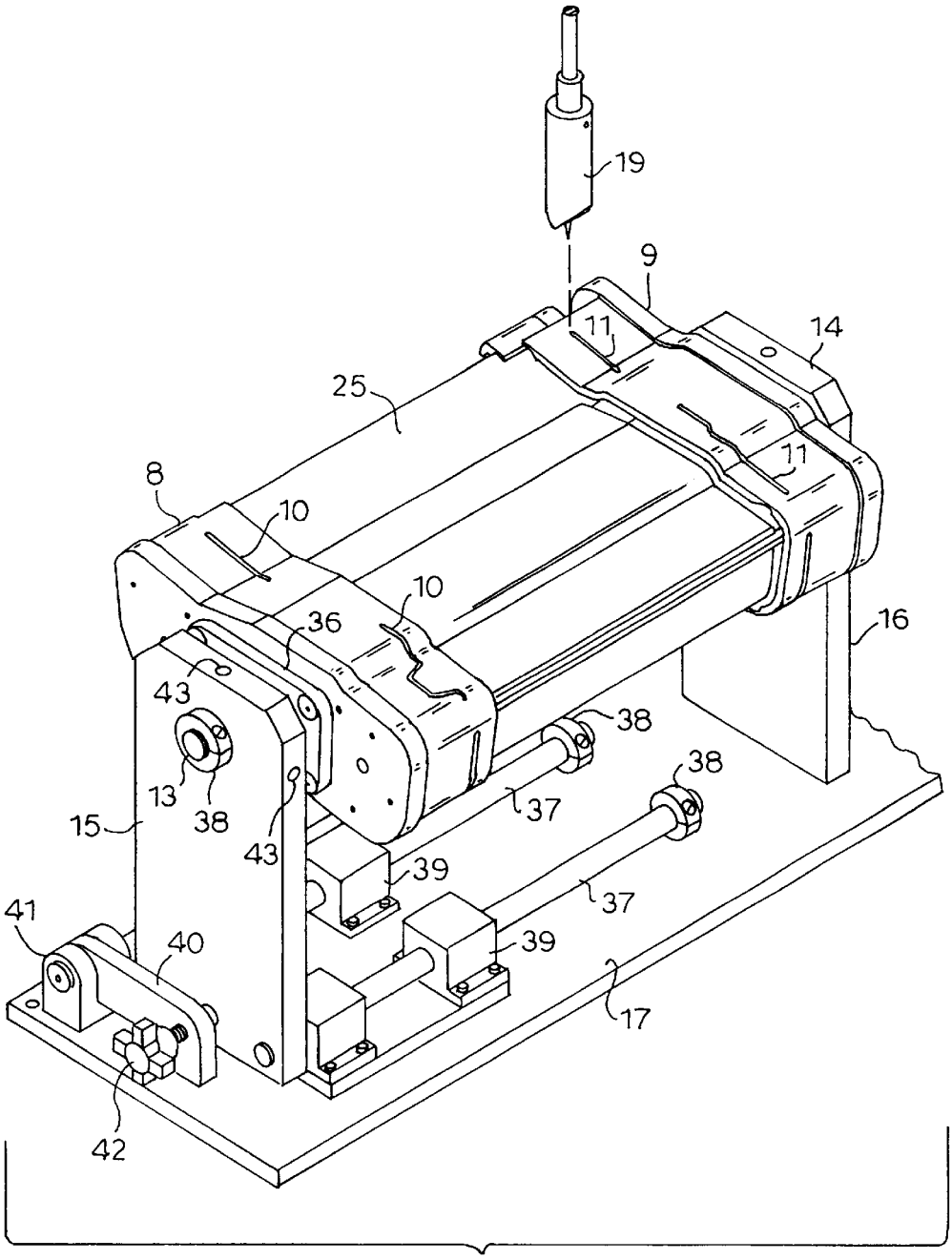
Figure 11:
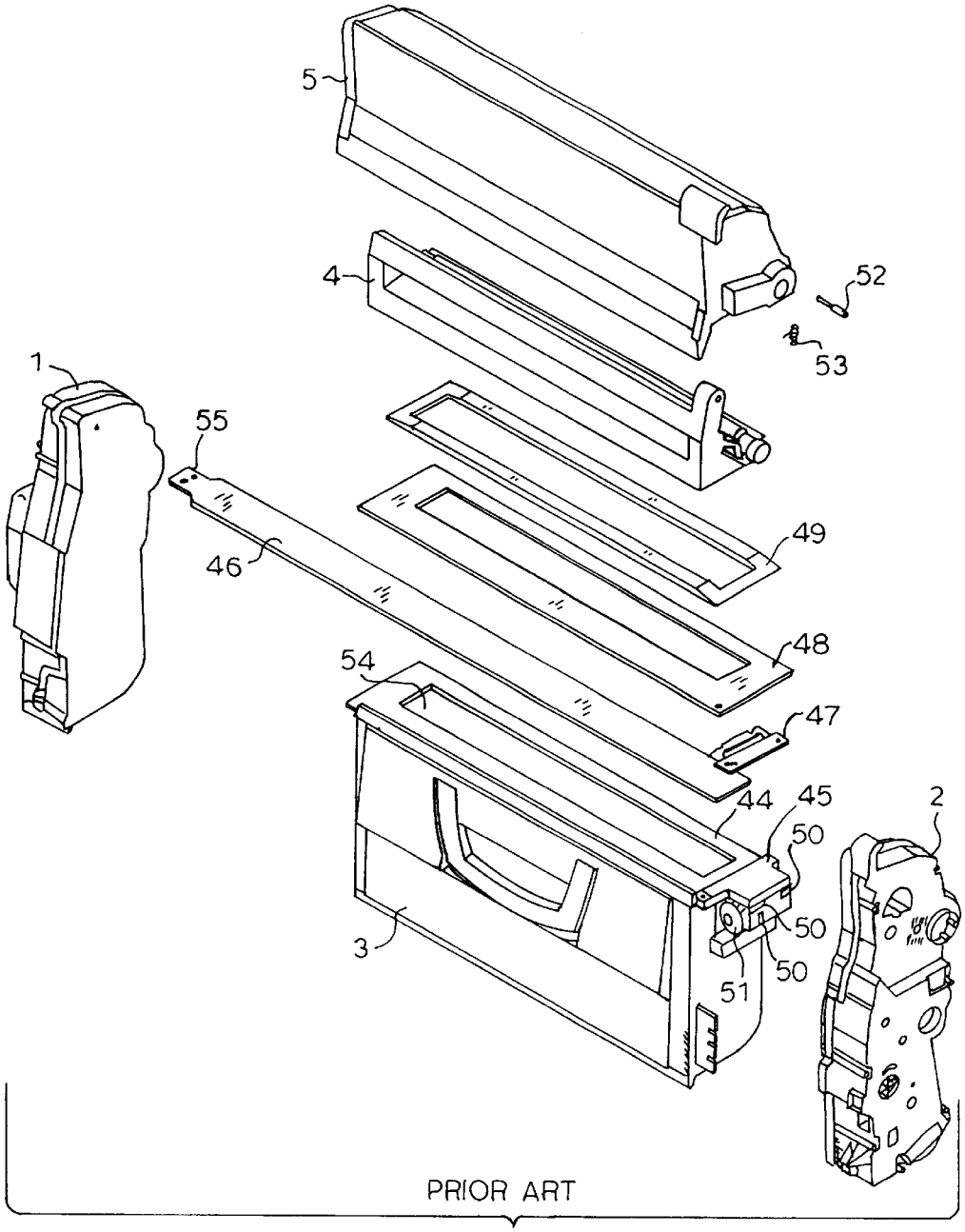
Figure 12:
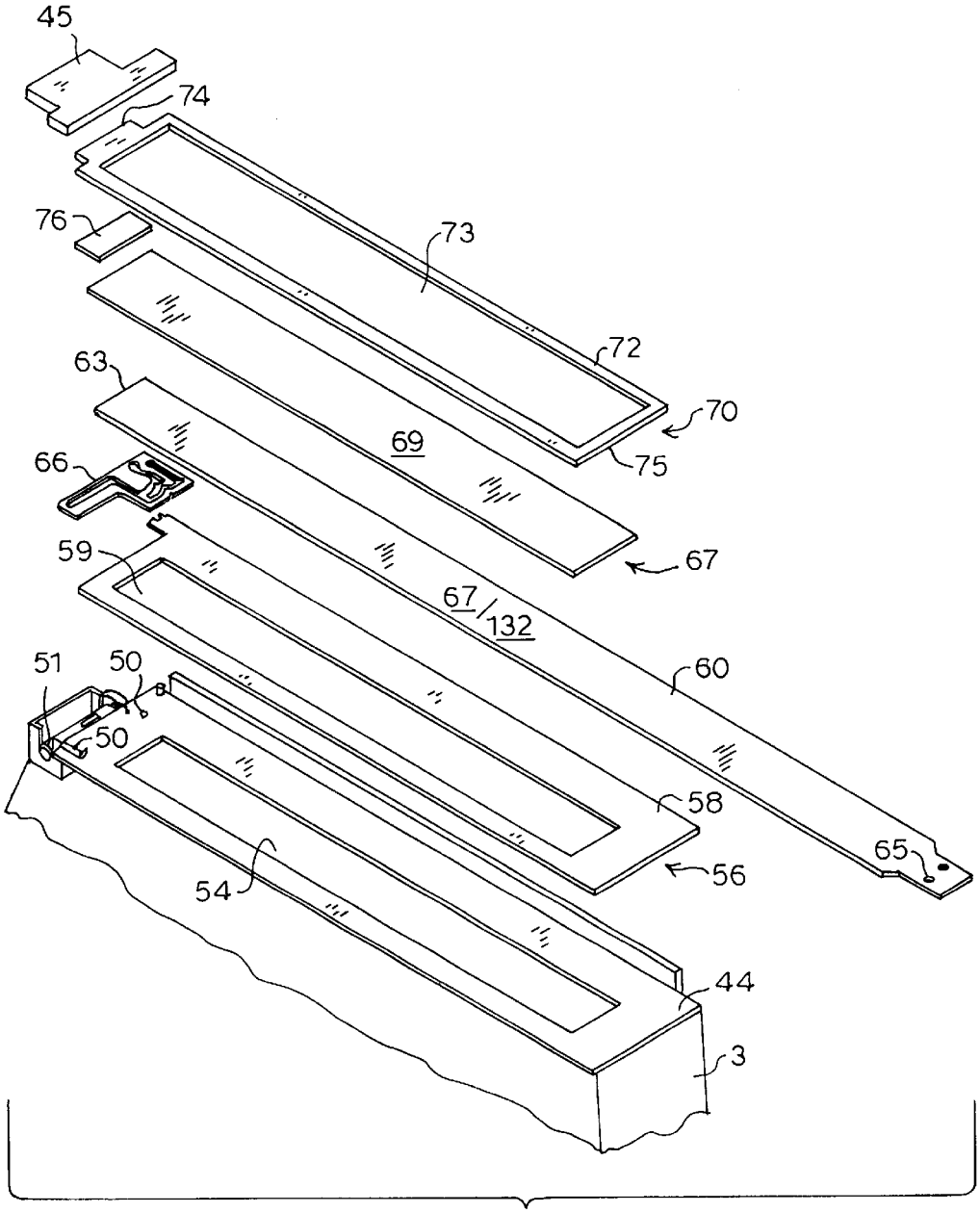
Figure 13:
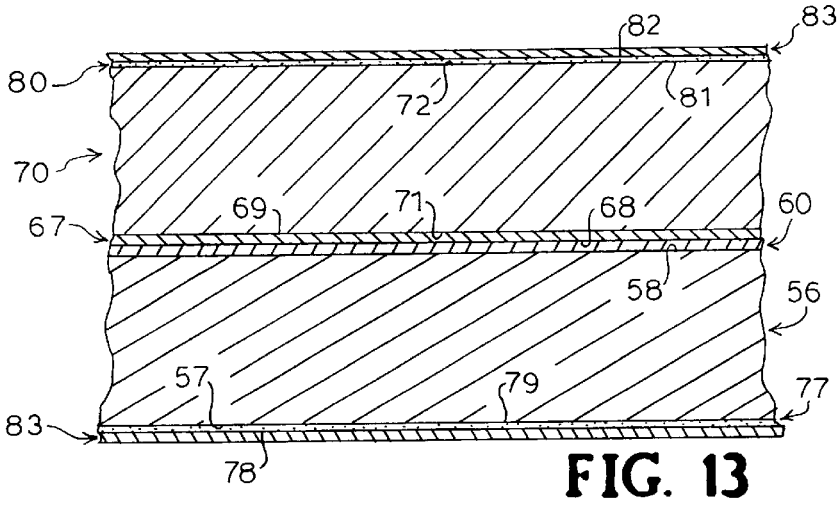

Figure Three is a view of the prior art toner cartridge in a toner cartridge splitter.

Figure Four is another view of the prior art toner cartridge in the toner cartridge splitter.

Figure Five is another view of the prior art toner cartridge in the toner cartridge splitter.

Figure Six is an exploded view of the first template.

Figure Seven is an exploded view of the second template.

Figure Eight is a top view of the first template, and second template in position on the prior art toner cartridge.

Figure Nine is a top view of the first template, and second template on the prior art toner cartridge.

Figure Ten is the alternate embodiment of the toner cartridge splitter.

Figure Eleven is an exploded view of the prior art toner cartridge.

Figure Twelve is an exploded view of a new seal assembly.

Figure Thirteen is a cross section of the new seal assembly.

Figure Fourteen A is the prior art seal electrical trace.

Figure Fourteen B is the seal electrical trace.

Figure Fifteen is a view of latch clips in operation.

Figure Sixteen is a view of post clips in operation.

Figure Seventeen A is a view of the screw clip.

Figure Seventeen B is a view of the screw clip template.

Figure Eighteen is a view of the prior art toner cartridge, the screw clip template, and screw clips.

Figure Nineteen is a top view of the prior art toner cartridge and the location of the screw clips.

Figure Twenty is a bottom view of the prior art toner cartridge showing the location of the screw clips.

Figure Twenty One is a view of the second end cap.

Figure Twenty Two is an exploded view of the seal electrical trace.

Figure Twenty Three is a top view of the seal electrical trace on the removable seal.

Figure Twenty Four is an exploded view of the prior art toner cartridge showing the location of the second end cap conductors.

DETAILED DESCRIPTION OF THE DRAWINGS

The present invention relates to a method of remanufacturing a toner cartridge, specifically a new design of toner cartridge typified by the design of the HP 9000 toner cartridge. This new design of toner cartridge is illustrated in Figures One and Two.

Figure One is a top view of the new type toner cartridge recently introduced by the OEM. The first end cap 1 is welded to the toner hopper 3 developer roller housing 4 and the waste bin 5 at the first end cap welds 6 assembly. The second end cap 2 is welded to the toner hopper 3 developer roller housing 4 and waste bin 5 at the second end cap welds 7. Figure Two is a bottom view of the same prior art device.

Figure Eleven shows an exploded view of the new type prior art toner cartridge. The toner hopper 3 has the OEM removable seal heat sealed to the toner hopper sealing surface 44. The OEM removable seal 46 therefore, covers the toner hopper discharge opening 54. The tail of the OEM removable seal 55 is folded over the heat sealed OEM removable seal 46 and is threaded onto the spool 51 under the spool cover 45. The intermediate plate is welded to the toner hopper 3 and also to the bellows seal 49. The bellows seal 49 is in turn welded to the developer roller housing 4. The developer roller housing 4 is attached to the waste bin 5 through the cartridge pin 52 and the cartridge spring 53. The first end cap 1 and the second end cap 2 are then welded to the toner hopper/developer roller housing/waste bin sub assembly in the cartridge.

Figure 24:
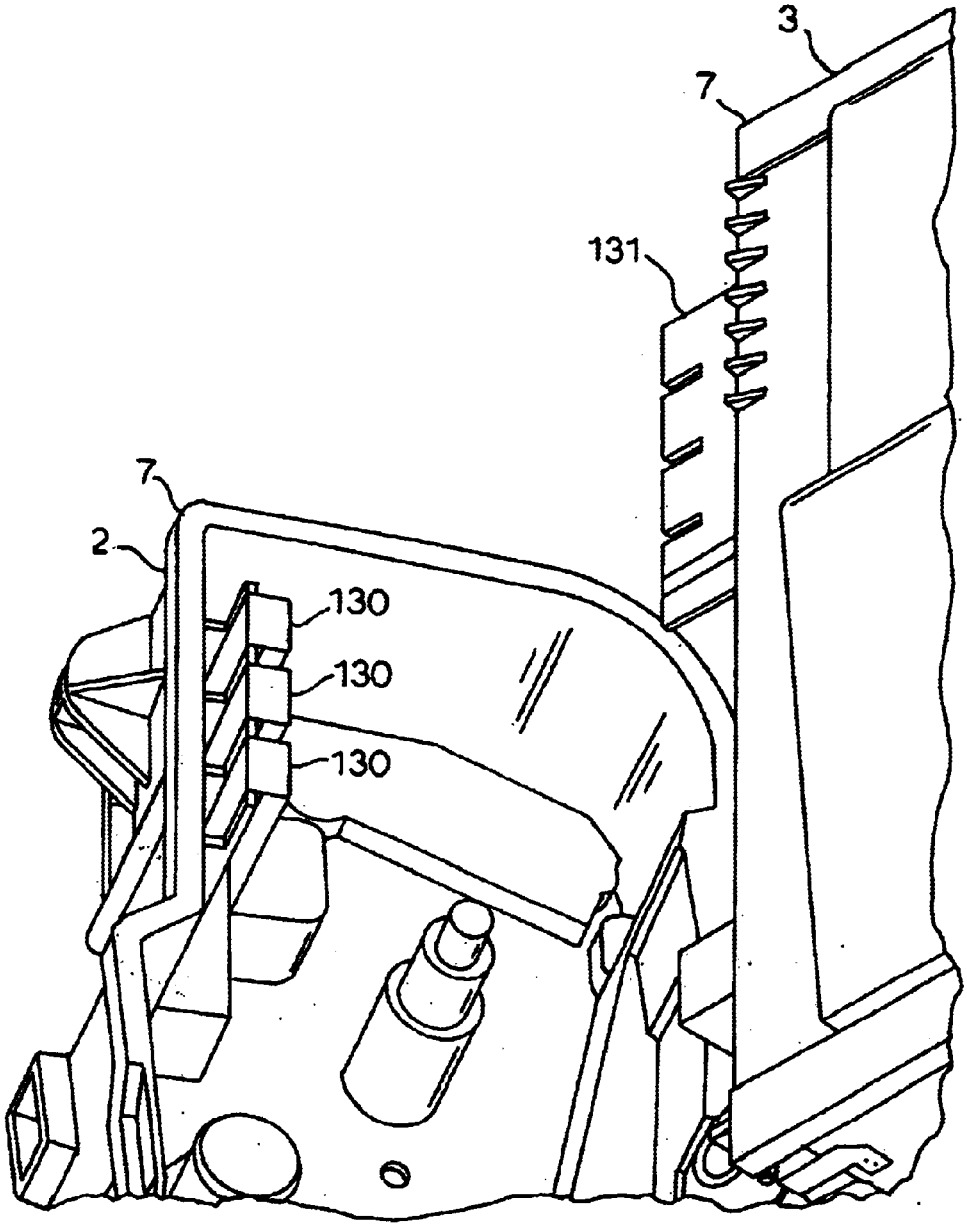
FIG. 24 PRIOR ART

A method of remanufacturing this new style toner cartridge can best be summarized as separating the first end cap 1 and the second end cap 2 from the remainder of the cartridge. The separation must be done in such a way as not to damage electrical contacts and to facilitate reassembly of the different components after the remanufacturing process is completed. The first step is to separate the first end cap 1, the second end cap 2, from the toner hopper 3, developer roller housing 4, and the waste bin 5. First end cap 1 can be separated by cutting the end cap away from the toner hopper/developer roller housing/waste bin sub assembly at the first end cap welds 6. Similarly, the second end cap 2 can be separated from the toner hopper/developer roller housing/waste bin sub assembly by cutting the second end cap 2 at the second end cap welds 7. Although these cuts may be done with a saw, knife, or other hand held device, the use of a toner cartridge end cap splitter facilitates making the cuts in the proper location, and to the proper depth. Figure Twenty Four illustrates the need to avoid cutting too deeply on the end caps. The second end cap 2 is shown in exploded view from the toner hopper 3. The second end cap weld 7 is the parting line between the second end cap and the toner hopper 3 in Figure Twenty Four. Immediately under the second end cap weld 7 are the second end cap conductors 130. The second end cap conductors 130 are in electrical communication with the first, second and third toner level contacts 116, 117, and 118 shown in Figure Twenty One. The second end cap conductors 130 are in electrical communication with the toner hopper conductors 131 shown in Figure 24 when the end cap is in place. Thus, it can be readily seen that if the second end cap weld 7 is cut too deeply, then the second end cap conductors 130 or the toner hopper conductors 131 will be damaged potentially destroying the electrical connection.

Figure Three depicts an embodiment of the toner cartridge end cap splitter. The toner cartridge 25 is placed in the first template 8 and a second template 9. The first and second templates are secured to the toner cartridge 25 by one or more straps 12 with a strap latch 127 which help pull the two templates toward one another thus securing the templates against the first and second end cap 1 and 2 (not shown). As depicted in Figure Three, the first end cap 1 (not shown) is under the first template 8 and the second end cap 2 (not shown) is under the second template 9. The first template 8 has first template openings 10 located above the first end cap welds 6 (not shown). Similarly, the second template 9 has second template openings 11 located over the second end cap welds 7 (not shown).

In placing the first template 8 and second template 9 onto the toner cartridge 25, the center rest 24 may be used.

Figure Four illustrates how this works. The center rest is a hollow cylinder inner diameter which is sized to fit the first template axle 13 or the second template axle 14. Either the first template 8 or the second template 9 may be placed in the center rest 24 in a cartridge inserted into the template. The other template may then be placed on the opposite end of the toner cartridge 25, and the straps 12 and strap latch 127 may be drawn together tightening them. The center rest 24 assists in attaching the first template 8 and the second template 9 to the toner cartridge 25.

Once the cartridge is inserted into the templates, the first template axle 13 and the second template axle 14 may be placed in the first upright 15, and the second upright 16. This is illustrated in Figures Three and Five. The first upright 15 and the second upright 16 have a first template axle holder 26, and the second template axle holder 27 sized to support the first template axle 13 and the second template axle 14. The first upright 15 and second upright 16 are attached to a base 17 which helps stabilize the entire arrangement. A tool hanger 18 is also attached to the base 17. The tool hanger 18 is used to support the rotary tool motor 28 of the cutting tool. In the preferred embodiment, a Dremel Tool, model 732, motoflex shaft tool with medium hand piece at the end of the flex piece is used. The rotary tool motor 28, is attached to the flexible shaft 23. The flexible shaft is in turn attached to the tool handle 22 which holds the bit 21. The bit 21 is encased in a retractable bit enclosure 19. The retractable bit enclosure 19 is designed to hold the drill bit at a desired distance from the end of the retractable tool cover when the retractable tool cover is fully retracted. An air supply 20, may be used to help cool the bit.

In the preferred embodiment a 0.375 inch cutting diameter, 188 thousands cutting edge length, ⅛ inch shaft, two flute 30 degree helix solid carbide bit is used. The bit is one and a half inches long in overall length. Because the Dremel model 732 spins at approximately 22000 rpm's, and because this speed is too high (causes excessive melting) the speed is reduced by using a rectifier 109 to cut the voltage. The preferred speed of the bit is between 6000 and 15000 rpm's, preferably 9000 and 12000 rpm's. In the preferred embodiment an air supply 20 is directed at the cutting head.

Using the toner cartridge end cap splitter, the remanufacturer places the toner cartridge 25 in the first template 8 and second template 9. The two template axles 13 and 14 are placed on the first upright 15 and second upright 16, the axles resting in the first template axle holder 26 and the second template axle holder 27. The retractable bit enclosure 19 is held in place by the operator over the first template openings 10 and second template openings 11 to make cuts in the first end cap welds 6 and the second end cap welds 7. The toner cartridge 25 may be rotated to facilitate cutting on both sides of the toner cartridge.

Figures Six and Seven show close-up details of the first template 8 and second template 9. Figure Six is an exploded view of the first template 8 to better show the locations of the first template post receptacle 30. The first template is shown in an exploded view as having two parts A and B. The preferred embodiment of the first template 8 is made in one piece of a metal material. Metal is preferred because it will resist being worn by the cutting tool used to cut the first end cap welds 6 and the second end cap welds 7. Aluminum is the preferred metal because it is easily worked and is lightweight. The Aluminum are preferably about ¼ inch thick. The first and second template openings are preferably 0.286 inches wide. Otherwise, a plastic or fiber reinforced plastic may be used. Care must be taken when using plastic to maintain the appropriate shape. Molded plastic can stress relieve distorting the shape. The first template 8 is placed over the first end cap 1. In the preferred embodiment, first template post receptacles are used to better align the first template openings 10 with the first end cap welds 6 that need to be cut. The first template post receptacles align with, and fit over the first end cap posts 29 shown in Figure Six. These posts are molded into the first end cap by the original equipment manufacturer. In the preferred embodiment the template post receptacles fit snugly over the end cap posts. For the HP 9000, the template post receptacles have an outer diameter of 0.31 inches, and an inner diameter of 0.22 inches.

Similarly, Figure Seven shows the second template 9 in two parts to better illustrate the location of the second template post receptacles. The second template is shown as being in two parts, 9*a* and 9*b*. In the preferred embodiment the first and second templates are a single piece preferable of some metal such as aluminum. The templates can be made in two parts for easier construction, but the inventors have found that two part construction reduces the accuracy of the alignment of the second template openings 11 with the second end cap welds 7. The second template post receptacles 32 are positioned to fit over the second end cap posts molded into the end cap by the original equipment manufacturer (OEM). Second template post receptacles are not necessary, but they do assist in aligning the cartridge more accurately. After the first template 8 and second template 9 have been placed over the first end cap 1 and the second end cap 2, the two templates should be snug against the two end caps.

There are several methods of securing the templates over the end caps. The preferred method is illustrated in Figures Eight and Nine. Figure Eight is a top view of the toner cartridge 25 held between the first template 8 and the second template 9. A strap 12 is used to connect the first template 8 and the second template 9 drawing them snugly against the end caps (not shown). The preferred method of connecting the two templates uses a fixed connector 33 and a strap latch 127. The fixed connector holds one end of the strap while the strap latch 127 uses a latching mechanism to draw the first template 8 toward the second template 9. Other connectors are readily apparent. For example, there may be latches at either end.

Figure Nine shows a bottom view of the toner cartridge 25 secured between the first template 8 and the second template 9. A strap 12 is shown drawing the first template 8 toward the second template 9 in the same fashion discussed above. A single strap may be used, or two straps as illustrated in Figures Eight and Nine.

There are other splitter embodiments possible. The template may, for example, be mounted vertically. In such a vertical mounting the template would be placed in a center rest 24 such as shown in Figure Four. The cartridge and template may then be rotated on the center rest 24 and cuts may be made through the first and second template openings 10 and 11. The advantage of such a design is it eliminates the first upright 15 and second upright 16. The disadvantage is that it is more difficult to make cuts when the templates mounted vertically. A single template for the second end cap could be used. The second end cap contains the second end cap conductors and care must be taken not to cut them. The first end cap could be cut free handedly.

Figure Ten illustrates yet another embodiment of the toner cartridge splitter. In the alternate embodiment shown in Figure Ten, the straps 12 and 35 are eliminated. The embodiment in Figure Eight the force moving the first template 8 toward the second template 9 is applied by the knobshoe 42, the pressure placed on the first upright 15.

Figure Ten shows the toner cartridge 25 mounted within the first template 8 and second template 9. The first template axle 13 protrudes through an opening in the first upright 15. It is secured with a locking collar 38. Similarly, the second axle 14 (not shown) protrudes through a similar opening in the second upright 16 and is secured with a locking collar. The first upright 15 is slideably engaged with the base 17. First upright 15 is mounted on Thompson shafts 37 which in turn are connected to the base 17 by pillow blocks 39. The first upright can be slid toward and away from the second upright by moving it along the Thompson shafts 37. Once the templates are engaged on the toner cartridge 25, the knobshoe 42 may be moved away from the first shaft or positioned toward this first shaft by swinging the swing arm 40 on the Pivot block 41. As shown in Figure Ten, the swing arm is engaged adjacent to the first upright. As shown in Figure Ten in the unengaged position, the swing arm 40 and the knobshoe 42 would not rest on the base. The knobshoe may be turned in order to incrementally push the first upright 15 toward the second upright 16 tightening the first template 8 against the second template 9 securing the cartridge in place. In either embodiment, the first upright and second upright are preferably 8½ inches tall to facilitate rotation of the toner cartridge.

Figure Eleven shows an exploded view of the OEM toner cartridge. This cartridge has been simplified to better illustrate the steps of remanufacturing. Once the end caps 1 and 2 have been removed using the toner cartridge splitter, then the waste bin 5 may be removed from the developer roller housing 4 by removing the cartridge pin 52 and the cartridge spring 53. The waste bin section may be cleaned, inspected, and any worn out components contained in this section such as the OPC drum may be replaced. Next the developer roller housing 4 must be separated from the toner hopper 3. Between the toner hopper 3 and the developer roller housing 4 is the OEM seal. The OEM seal contains a number of parts. The OEM removable seal 46 is heat sealed to the toner hopper sealing surface 44 so that it completely covers the toner hopper discharge opening 54. The tail of the OEM removable seal 55 was folded over the length of the OEM removable seal and placed under the spool cover 45. The end of the tail 55 was threaded onto the spool 51. At the time of remanufacturing the OEM removable seal 46 was wound around the spool 51. The intermediate plate 48 is welded to the toner hopper 3 and to the bellows seal 49. Bellows seal 49 is in turn welded to the developer roller housing 4. The developer roller housing 4 can be separated from the toner hopper 3 by simply wedging or knifing apart these two sections. In the process, the intermediate plate 48 should be removed and discarded and the OEM removable seal 46 should be taken from the spool and discarded. Similarly, the Bellows seal 49 should be removed from the developer roller housing 4.

The cartridge has now been completely disassembled, and all sub components may be inspected, and any that are worn may be replaced. A replacement seal may now be added over the toner hopper.

Figure Twelve illustrates the construction of the new replacement seal. Figure Twelve shows the toner hopper 3 with the spool 51 and seal sensing contacts 50 after the old seal has been removed. The toner hopper sealing surface 44 has been scraped clean. Solvent has been used to remove any traces of the OEM material. The first gasket 56, the first side 57 (not shown) and a second side of the first gasket 58, the first side of the first gasket 57 is oriented toward the toner hopper sealing surface 44 and is designed to be adhered to the toner hopper sealing surface. In the preferred embodiment the first gasket 56 is high impact polystyrene. HCC grade 840 from Huntsman Chemical Corporation works well. The high impact polystyrene imparts rigidity to the seal assembly.

First gasket 56 has a first gasket opening 59 which is approximately the same size and shape as the toner hopper discharge opening 54. The removable seal 60 has a first side (not shown) and a second side 62. The first side is oriented toward the second side 58 of the first gasket 56 and is attached to the gasket. The removable seal has a tail 65 at the second end of the removable seal. This tail is folded back over the second side of the removable seal 62 and is threaded onto the spool 51. The seal electrical traces 66 are located at the first end of the removable seal 60. The seal electrical traces are in contact with the seal sensing contacts. In the preferred embodiment, the removable seal 60 is made of a metallized polyethylene film or a polypropylene ribbon material.

In the preferred embodiment, a two layer removable seal is used. A flexible seal material 132 may be laminated to a polypropylene ribbon 67. In the preferred embodiment, the polypropylene ribbon is a 0.005 inch thick unembossed white polypropylene ribbon. Flagship Converters, PT 8×10. The Polypropylene ribbon 67 provides preferential tearing in the desired direction while the removable seal 60 may be made of a metallized film to impart greater strength to the laminate. The flexible seal material 132 is preferably metallized film such as Lamigas 99103, a 0.006 inch thick nylon, aluminum, polyethylene laminate.

A second gasket 70 forms the next layer. In the preferred embodiment the gasket is an open cell foam such as a 0.125 inch thick Nolaphil. The foam gasket helps seal outside the cartridge preventing toner migration after the removable seal has been opened. The first side of the second gasket 71 (not shown) is attached to the second side of the first gasket 58. The second gasket 70 may also be attached to the second side of the removable seal 62 or to the second side of the ribbon seal material 69. The second gasket has a gasket opening 73, a first end 74 and a second end 75. The first side of the second gasket 71 (not shown) is sealed along its length, and along the second end of the second gasket 75. It is not, however, sealed at the first end of the second gasket 74.

The tail of the removable seal 65 which is doubled back over the removable seal 60 passes under the second gasket 70 at the first end of the second gasket 74. An optional lubricating layer 76 may be attached under the second gasket 70 attached to the first side of the second gasket 71 (not shown) at the first end of the second gasket 74. This lubricating layer may be made out of a PTFE or Mylar material to aid the sliding of the seal material. In the preferred embodiment this is approximately 0.004 inch thick Melinex from Thonsil Wrap Corp. The lubricating layer 76 helps avoid having the removable seal 60 stick or jam as it passes under the second gasket 74.

Although two gaskets are shown in Figure Twelve, the first gasket could be omitted and the removable seal 60 could be adhered directly to the toner hoper sealing surface 44 by heat sealing, glue or a pressure sensitive adhesive layer.

Figure Thirteen shows the replacement seal in cross section. In the preferred embodiment the seal has a first adhesive layer 77 and a second adhesive layer 80 as well as a release liner which covers the adhesive layers. The first adhesive layer 77 connects the seal assembly to the toner hopper and the second adhesive layer 80 connects the seal assembly to the developer roller housing. When installed, the developer roller housing is attached to the seal assembly which in turn is attached to the toner hopper. As shown in the cross section in Figure Thirteen, moving from the first adhesive layer 77 there is the first gasket layer 56. The adhesive layer is attached to the first side of the first gasket layer 57. The second side of the first gasket layer 58 is attached to the first side of the removable seal 63. The second side of the removable seal 64 is attached to the first side of the polypropylene ribbon seal material 68. The second side of the polypropylene ribbon seal material 69 is connected to the first side of the second gasket 71. The second side of the second gasket 72 is attached to the first side of the second adhesive layer 81. The second side of the second adhesive layer 82 is attached to a release liner 83. The first adhesive layer 77 is preferably MMM 950, an acrylic pressure sensitive adhesive. The second adhesive layer is preferably an Avery 8302. It also is an acrylic pressure sensitive adhesive. The adhesive layers could be omitted, and a glue used by the installer to attach the seal assembly to the toner hopper and developer roller.

Figure Fourteen B shows the seal electrical trace 66 of a new replacement seal and contrasts it to the OEM electrical traces 113 shown in Figure Fourteen A. As seen in 14A, the OEM electrical trace 113 has three holes corresponding to the three seal sensing contacts 50A, 50B, and 50C. Each of the three seal sensing contacts 50 on the toner hopper registers with these holes. An electrical connection is made from 50A to 50C through the conductive path 114. If the seal sensor 50A is in electrical contact with the seal sensor 50C, the printer knows that the seal is in place, and has not been opened. The printer then activates an appropriate circuit to cause the spool 51 to wind the tail of the OEM removable seal 55 onto the spool. The removable seal is then gradually pulled off the toner hopper sealing surface. The pulling open of this removable seal causes the seal tear along the seal tear line 112, thus breaking the electrical contact between the seal sensor 50A and seal sensor 50C. The printer then knows that the seal has been fully removed, and ceases to activate the spool. The electrical connection between 50B and 50C is made through a conductive path 114 which runs under the OEM insulative plastic tape 115. The existence of an intact electrical connection between 50B and 50C tells the printer that a cartridge is in place.

Figure 14A:
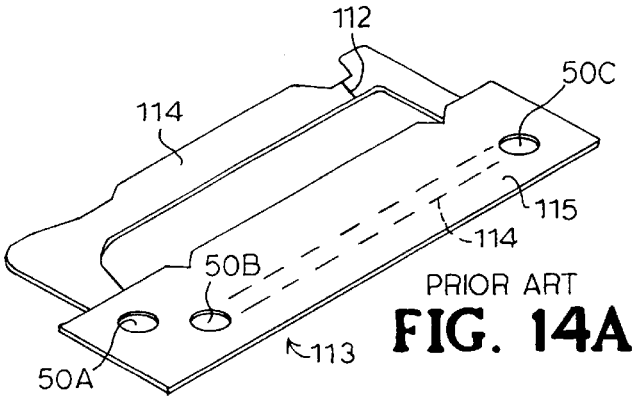
PRIOR ART FIG. 14A
Figure 14B:
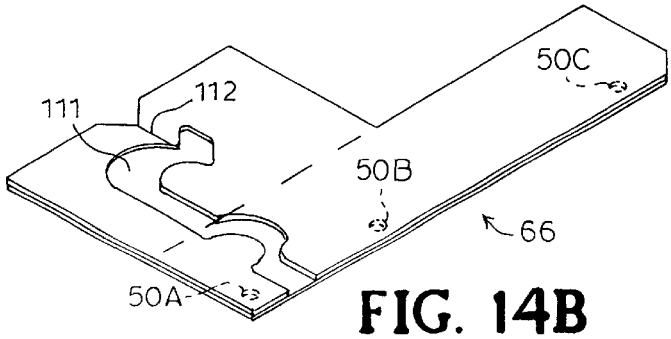
Figure 15:
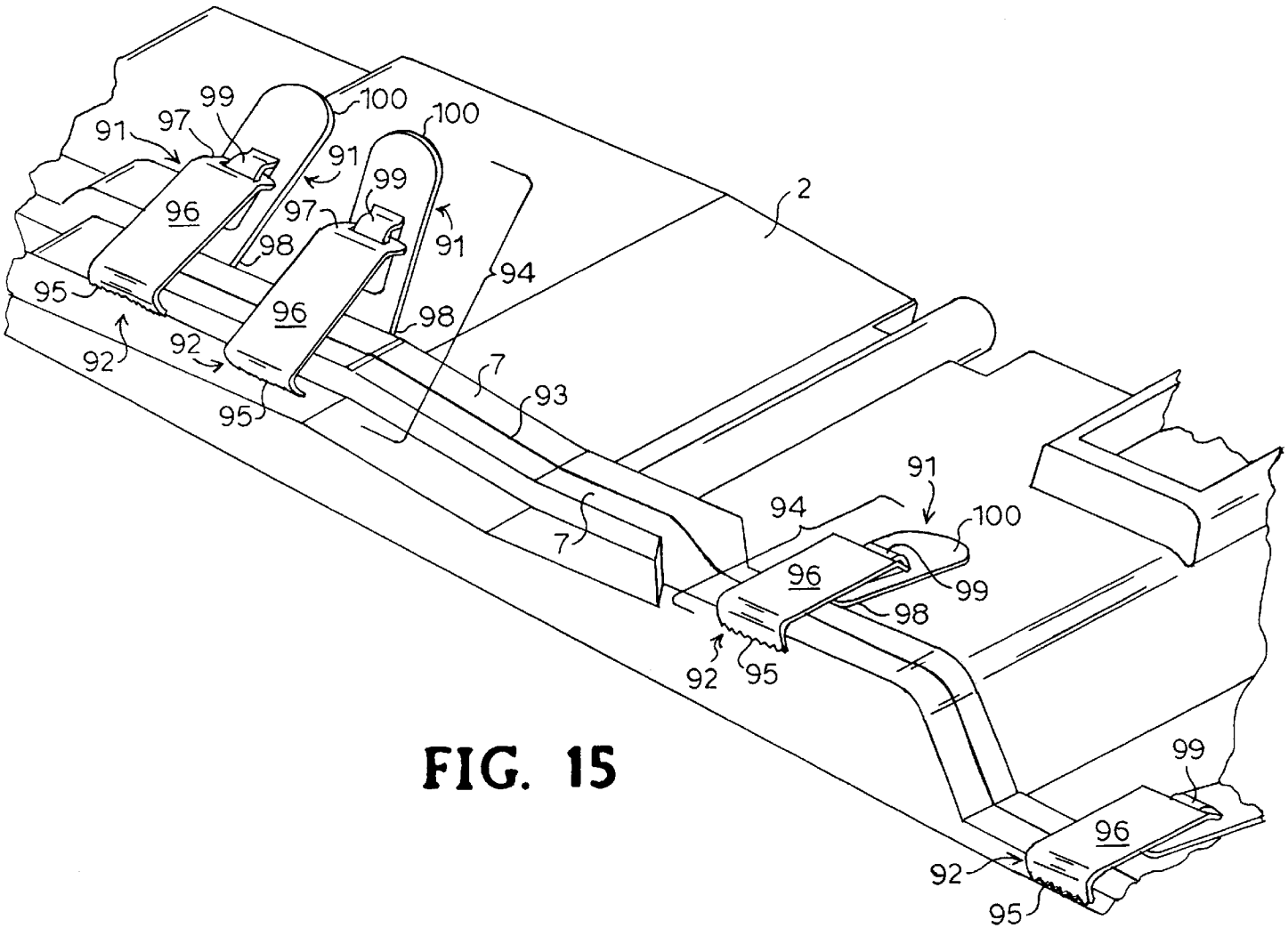
Figure 16:
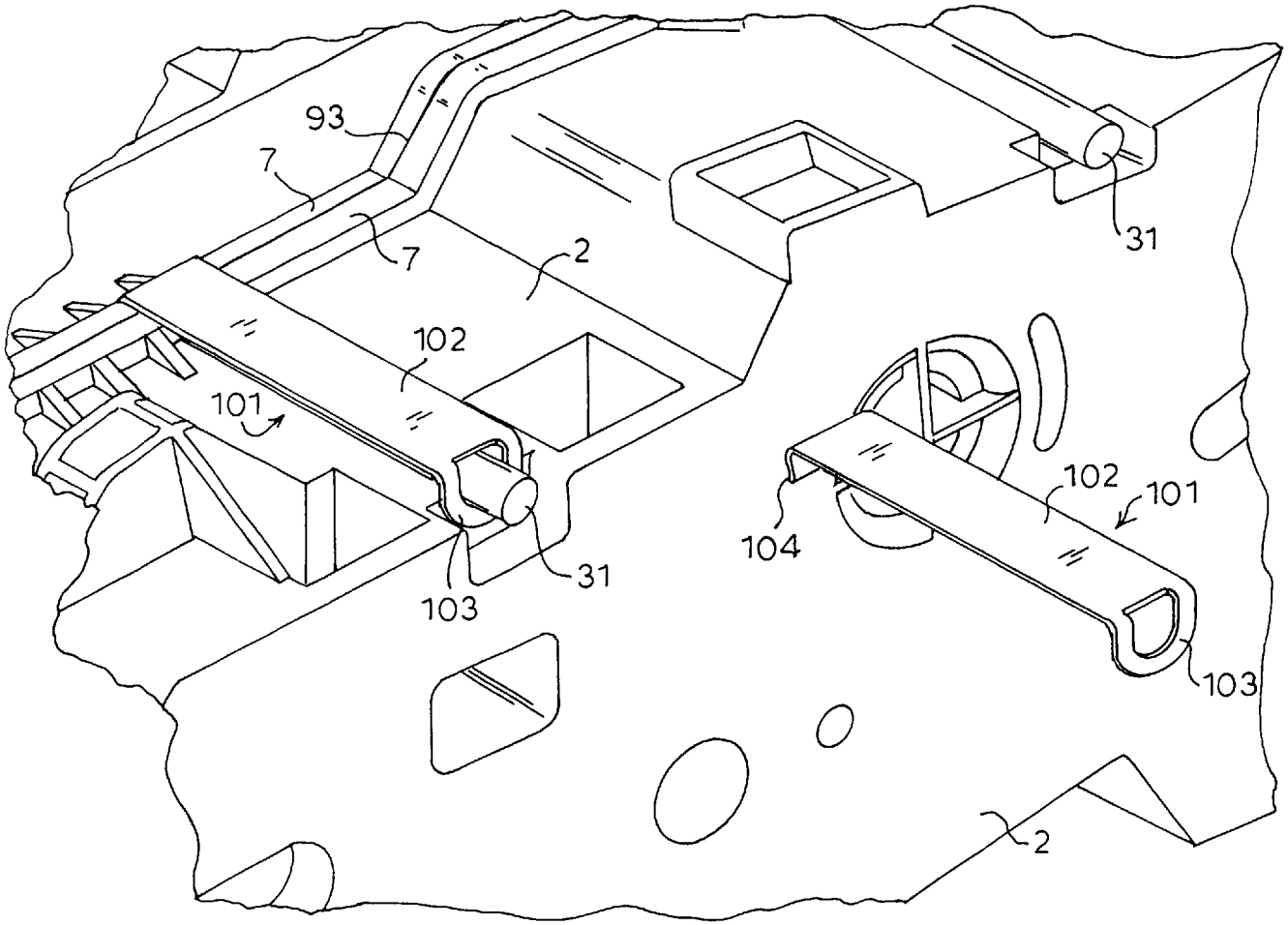
Figure 17A:
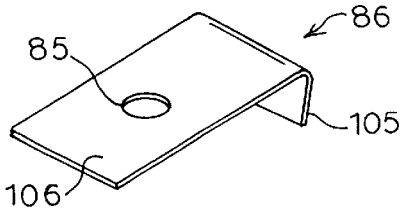
Figure 17B:
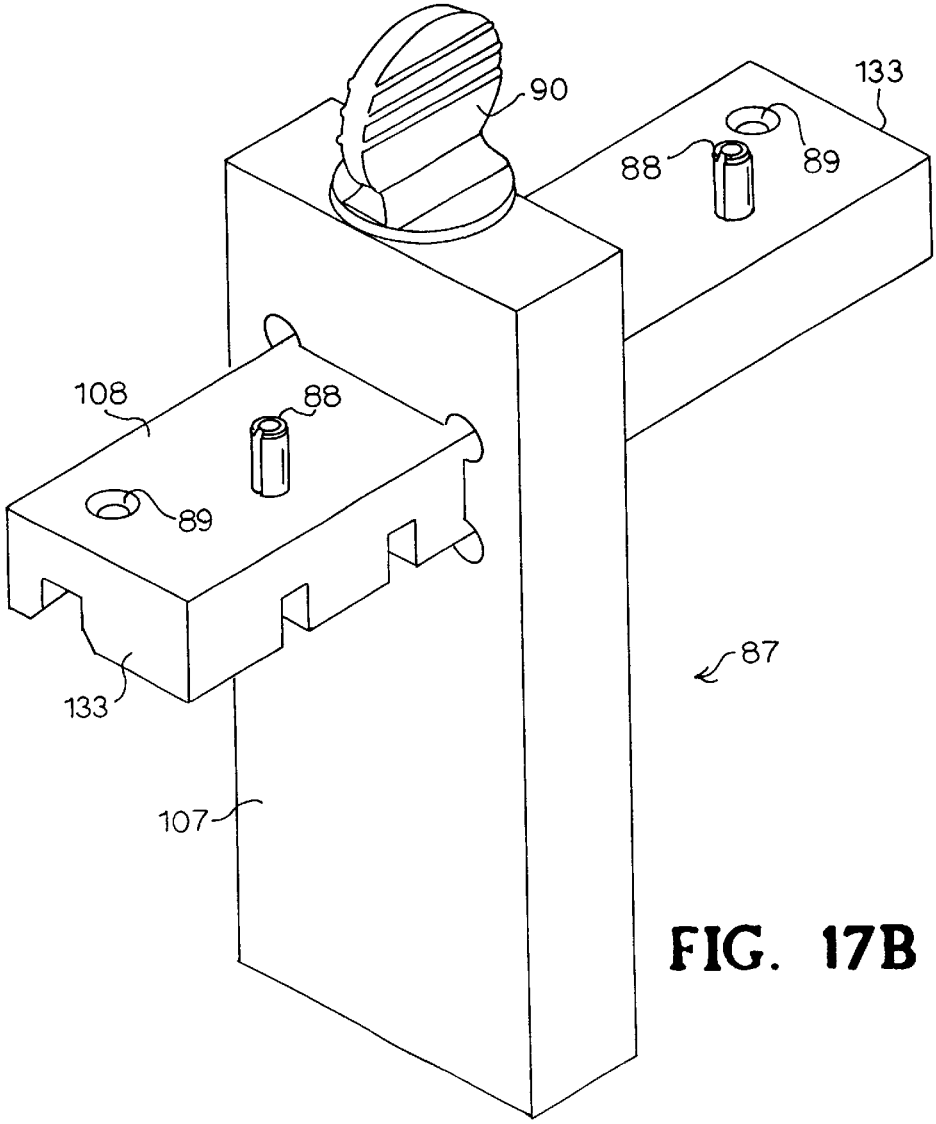
Figure 18:
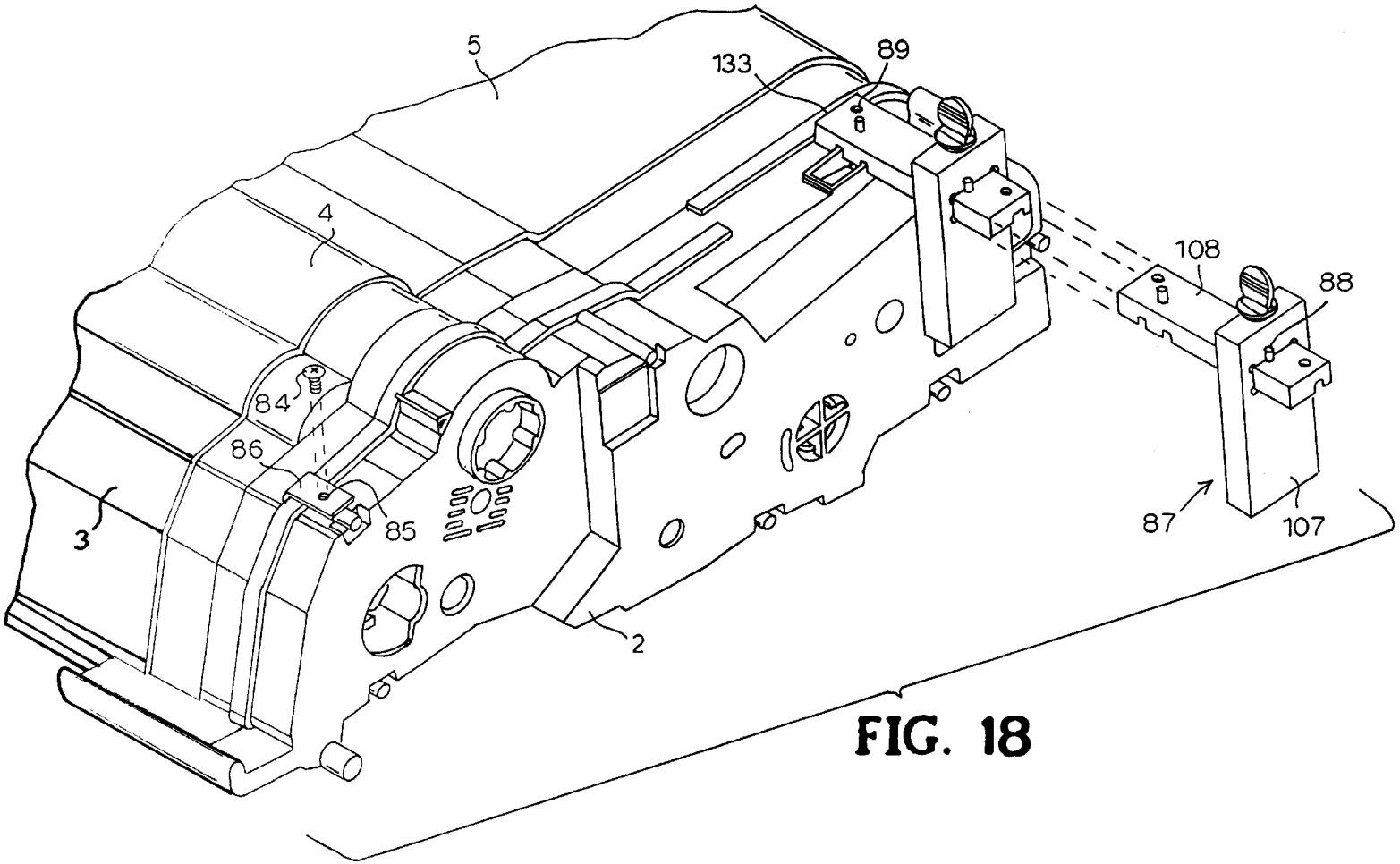
Figure 19:
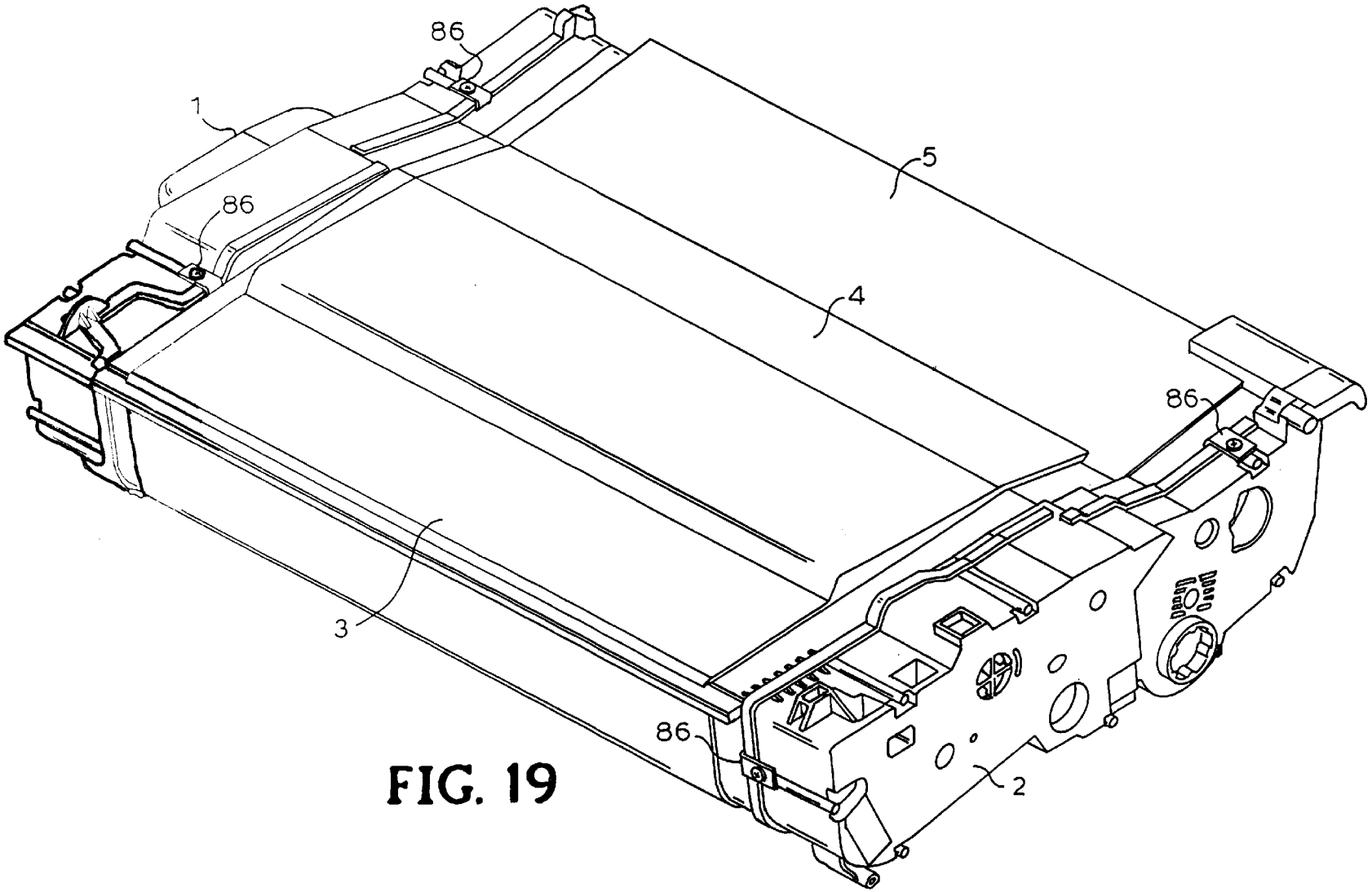
Figure 20:
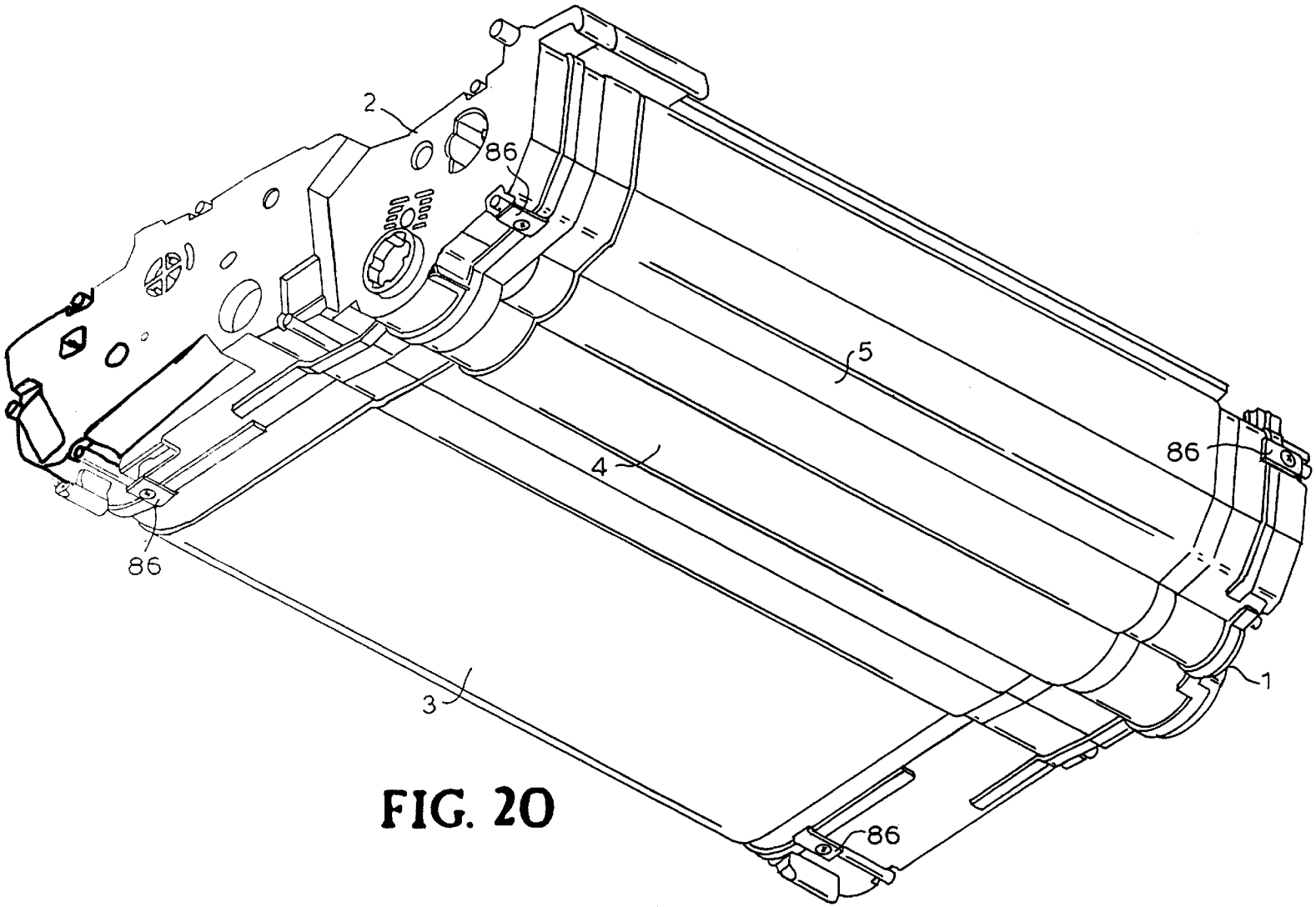
Figure 21:
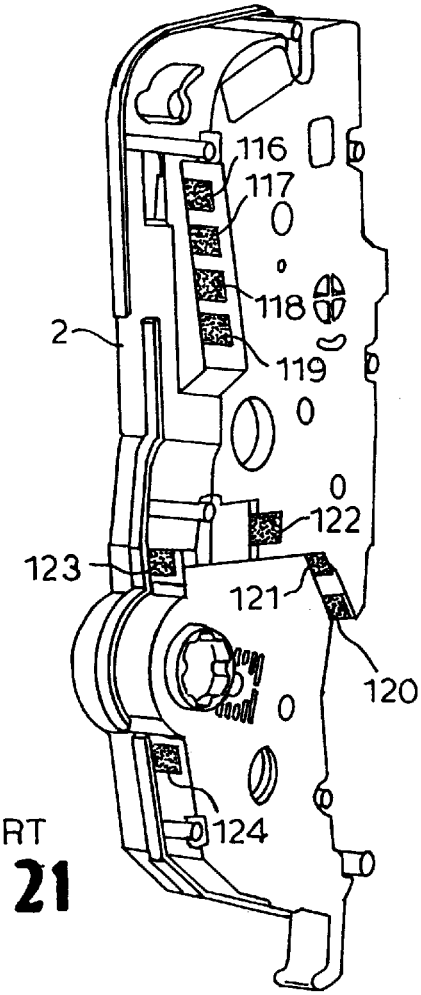
PRIOR ART FIG. 21
Figure 22:
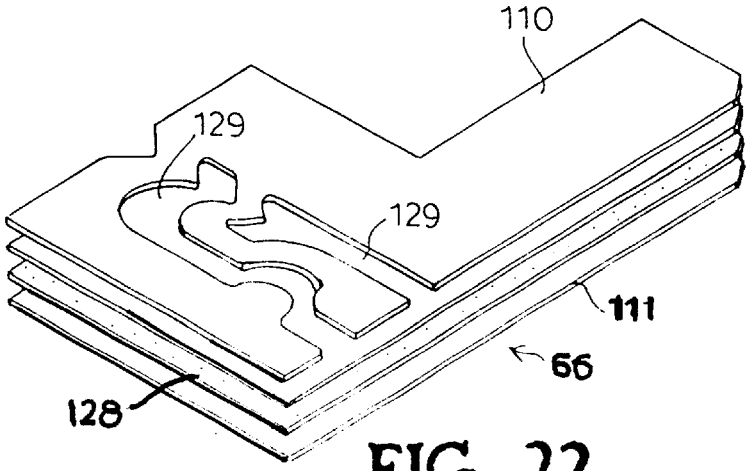
Figure 23:
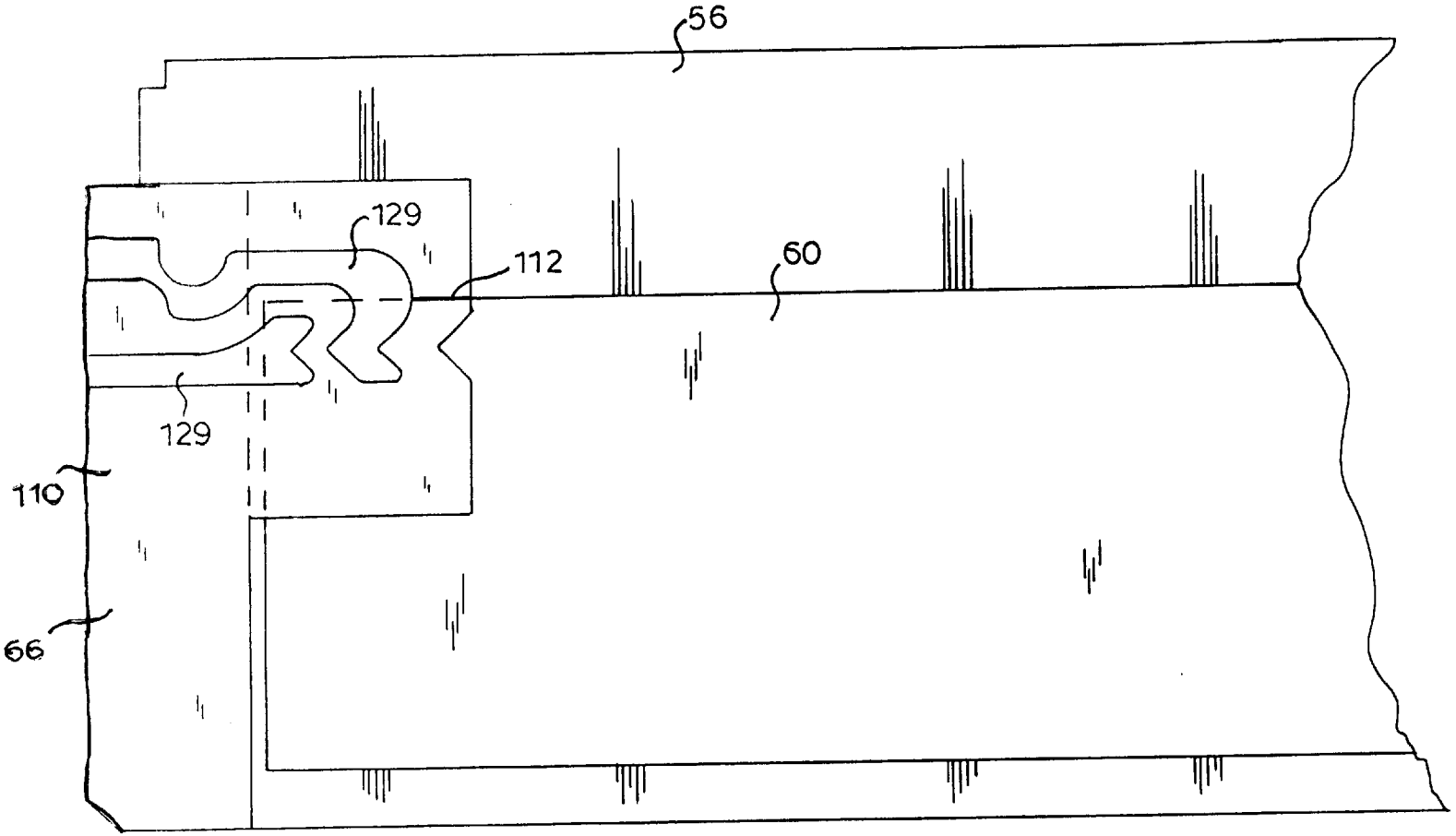

The replacement seal electrical traces shown in FIGS. 14B and 22 emulates the function of the prior art trace with less expense. The seal sensing electrical trace 66 has three layers. The top layer is a conductive layer 110. In the preferred embodiment, the conductive layer 110 is an aluminum foil, but other conductive materials such as metal foils, or a conductive plastic may be used. A portion of the conductive layer of the seal electrical traces is cut and removed. This exposes the insulative layer of the seal electrical traces 111 shown in FIG. 14B. In the preferred embodiment the insulative layer of the seal electrical traces 111 is a release liner, and covers the adhesive layer of the seal electrical trace. A portion of the release liner can be removed and the seal sensing electrical trace 66 can be adhered to the rest of the seal assembly.

Figure Twenty Two shows an exploded view of one embodiment of the seal electrical traces 66. As illustrated in Figure Twenty Two, the seal electrical trace 66 has three layers. The bottom most layer is the insulative layer of the seal electrical traces 111, and is preferable a release liner. The middle layer is the adhesive layer of the seal electrical trace 128. The top layer is the conductive layer of the seal electrical traces 110. As shown in Figure Twenty Two, the removed portions of the conductive layer 129 create two conductive paths in the conductive layer. In the preferred embodiment, Compac 804 aluminum tape from Compac Industrial Tape Division is used. The tape is an adhesive tape with release liner which contains all three layers. The metal foil is die cut, and the cut portion of the tape removed to create the appropriate electrical paths.

Figure Twenty Three shows the seal electrical trace 66 in place over the removable seal 60 as the spool 51 (not shown) pulls the tail of the removable seal 65 (not shown). Removable seal 60 is pulled from the first gasket 56 which covers the toner hopper sealing surface 44 (not shown). As removable seal 60 is pulled, it breaks the conductive layer of the seal electrical traces 110 at the seal tear line 112.

After seal electrical trace 66 is placed over the removable seal 60, the seal electrical trace 66 is then slid under the seal sensing contacts 50. The seal sensing contact 50A is in electrical contact with seal sensing contact 50C through the conductive layer of the seal electrical trace 110. This connects between 50A and 50C from a first conductive path. The printer senses this electrical contact. It then activates the spool 51 pulling the tail of the removable seal 65 and opening the seal. When the seal has been opened along the tear line 112, sensor 50A is no longer in electrical contact with sensor 50C as the first conductive path is broken. The printer stops activation of the seal. Sensor 50B remains in electrical contact with sensor 50C through the conductive layer in a second conductive path. This embodiment allows easy attachment of the seal sensing traces to the removable seal, and ease of construction. Although Figure 14B shows that two areas of the conductive layer have been removed, exposing the insulative layer of the second electrical trace 111, a single area of the conductive material can be removed to create the two electrical paths. In the alternative, pads corresponding to the seal sensors 50A, 50B, and 50C may be placed on the seal and wire connecting the pad in contrast with 50A to the pad with 50C, and the pad in contract with 50B to the pad in contract with 50C.

After the replacement seal assembly is installed between the toner hopper 3 and the developer roller housing 4, the waste bin 5 is reattached to the developer roller housing 4 and the cartridge pin 52 and spring 53 are replaced. The toner hopper/developer roller housing/waste bin sub assembly is now ready for the end caps to be reattached. The end caps may be simply glued or caulked onto the toner hopper/developer roller housing/waste bin sub assembly. However, this is not the preferred method of reattachment since it would necessitate splitting the cartridge again using the end cap splitter described above. Although the toner cartridge splitter described above allows repeatable cuts to be made, some errors in cutting will inevitably occur. If the same cartridge is cut time and time again, eventually either the end cap, the end cap contacts or the toner hopper/developer roller housing/waste bin sub assembly will be damaged. A better method of reconnecting the end caps to the sub assembly is by use of a series of removable clamps. These clamps also offer a further advantage in that they may be more speedily disconnected when the toner cartridge returns to be remanufactured yet again. A variety of means may be used to clamp the end caps onto the sub assembly. The first end cap welds 6 and the second end cap welds 7 are raised above the profile of the rest of the body of the first end cap 1, second end cap 2, or the body of the toner hopper/developer roller housing/waste bin sub assembly. When the first template and second template are properly aligned, a cut will be made at the center of the first end cap welds 6 and the second end cap welds 7. Because the end cap welds are raised above the surface of the end cap and the toner hopper/developer roller housing/waste bin sub assembly can be used as a point to exert clamping force holding the end caps 1 and 2 on the toner hopper/developer roller housing/waste bin sub assembly.

Figure Fifteen shows one such clamping mechanism. The latching clip 94 has two pieces. The first piece is the clip lever 91 and the second piece is the clip latch 92. The clip latch 92 has three sections. The first section is the clip latch base 96. The clip latch base 96 is essentially planar and engages the top of the second end cap weld 7 on either side of the split in the second end cap weld 93. The second section of the clip latch 92 is the gripping end of the clip latch base. It is designed to engage the raised part of the second end cap weld 7 on the toner hopper/developer roller housing/waste bin sub assembly side. The third portion of the clip latch 92 is the clip latch mating section 97. The clip latch mating section 97 is at an angle to the clip latch base 96 and is shaped to engage the clip lever 91. The clip lever is essentially planar. It has a clip lever engaging end 98, a clip lever mating section 99, and a lever end 100. The clip lever engaging end 98 makes contact with the base of the end cap welds on the end cap side. As shown in Figure Fifteen the clip lever engaging end 98 makes contact with the base of the second end cap weld 7 at the second end cap 2. By pressing down on the lever end 100, the clip lever mating section 99 draws the clip latch mating section 97 down toward the second end cap weld 7. This in turn causes the gripping end of the clip latch 95 to engage the second end cap weld 7 and be drawn toward the clip lever engaging end 98 resulting compressive force between the clip lever engaging end and the gripping end of the clip latch 95 clamping the end cap 2 to the toner hopper/developer roller housing/waste bin sub assembly. Multiple latching clips 94 may be used to engage the first end cap 1 and the second end cap 2 to the toner hopper/developer roller housing/waste bin sub assembly.

Another alternate clip is shown in Figure Sixteen. The post clip 101 has three sections. Post clip base 102, the end cap post mating section 103, and the post clip engaging end 104. The Post clip engaging end 104 makes an approximate 90° angle to the post clip base 102. The post clips 102 are used to attach the end caps to the toner hopper/developer roller housing/waste bin sub assembly by placing the post clip engaging end 104 over the first end cap post 29 (not shown in Figure Sixteen) and the second end cap post 31. This attaches the end cap post mating section to the end caps. The post clip engaging end 104 is then attached over the top of the end cap welds and engages the toner hopper/developer roller housing/waste bin sub assembly on the other side of the weld. In the preferred embodiment of this clip, the post clip 101 is made of a springy material such as spring steel. By pressing down on the post clip base 102, the post clip engaging end 104 is forced over the top of the weld and will exert a compressive force between the end cap and the toner hopper/developer roller housing/waste bin sub assembly over the weld.

Figure Seventeen A shows a screw clip for use in reattaching the end caps to the toner/developer roller housing/waste bin sub assembly. A screw clip 86 has a screw clip engaging end 105, which forms approximately a 90° angle with the screw clip base 106. In the preferred embodiment this angle is less than 90° to facilitate exerting a clamping pressure. This screw clip base 106 has a screw clip hole 85.

The clip screw template 87 is shown in Figure Seventeen B. The clip screw template 87 is used to locate the holes in the end caps to correspond to the screw clip holes 85. The body of the clip screw template 107 is placed against the side of either the first end cap 1 or the second end cap 2. The slide of the clip screw template 108 is then pushed until the template slide end, 108*a*, 108*b*, cones to rest against the side of the first end cap weld 6 or second end cap weld 7. The clip screw template thumbscrew 90 is then tightened to secure the alignment of the body of the clip screw template 107 relative to the clip screw template slide 108. The pilot hole 89 will then be correctly located over the appropriate section of the end cap. When properly located, the pilot hole is far enough from the first end cap weld 6, or the second end cap weld 7 to avoid splitting the plastic at the end cap weld, but close enough to provide pressure against the end cap weld when the screw is inserted and tightened. In the preferred embodiment this distance is approximately 0.188 inches. A drill, not shown, can then be used to drill vertically down through the pilot hole 89 and into the first end cap 1 or the second end cap 2. This will correctly gage the location of the screw clip 86.

Figure Eighteen shows the clip screw template 87 correctly engaged against the second end cap 2. The clip screw template body 107 is seated against the outer surface of the second end cap 2, and the clip screw template slide end 133 is seated against the second end cap weld 7. Pilot hole 89 is now over the appropriate location on the end cap 2. The preferred locations are illustrated in Figures Nineteen and Twenty for such clip screws, other locations are readily apparent. Figure Nineteen shows a top view of the location of the installation of the screw clips 86. Figure Twenty shows the location of the preferred location of screw clips 86 on the bottom of the toner cartridge. Note that four clips are able to hold the end caps onto the cartridge. In the preferred embodiment the screw holes in the end caps are pre drilled. Clip screws are preferably made of a spring metal, although a plastic material may be used. Clip screws are engaged against the first end cap welds 6 or the second end cap welds 7. The screw is then inserted through the screw clip hole 85 and into the end cap. Tightening the screw draws the clip against the end cap welds attaching the end caps to the toner hopper/developer roller/waste bin sub assembly.

Using any of these clips the cartridge may be readily disassembled on its next cycle through remanufacturing without need of cutting any welds. In the preferred embodiment 303 stainless steel, ¾ head tempered is used for its rigid and non-rusting properties. For cosmetic purposes they may be colored black to match the cartridge such as by black oxide treatments.

Although the above cited method has the same end caps being reused on a toner cartridge, there are other alternatives. For example, end caps from various different individual toner cartridges may be mixed and matched. This is, the first end cap from toner cartridge A may be placed as a first end cap on toner cartridge B. Similarly, new end caps can be molded and used as replacement end caps. The use of a new first end cap, or a new second end cap allows for greater flexibility in cutting the cartridge since care may not be taken to ensure that the cartridge parts are all reusable. The use of a new replacement end cap does, however, add expense to the process.

After the cartridge has been reassembled, it may be sold by the remanufacturer directly to a customer. Most remanufacturers prefer to test their cartridges before sending them to their customers. By testing the cartridge they can be sure that the various new and used components work properly together to produce an appropriate image. Post testing the HP 9000, or other cartridges of this design present certain unique problems. When toner cartridges of this design is placed in the printer, the printer senses the presence of the cartridge through the seal sensing contacts 50.

As noted above, when the printer senses that a cartridge is in place, the printer sends a signal causing the spool 51 to wind. If the cartridge has been newly remanufactured, the winding of the spool will pull the tail of the removable seal 65 eventually removing the removable seal 60 allowing toner to pass through the first gasket opening 59 and the second gasket opening 73. Because the seal is installed to prevent toner from leaking during shipping, a remanufacturer needs to be able to test the toner cartridge without removing this seal.

In order to post test the toner cartridge but leave the replacement seal in place, a remanufacturer needs to fool the printer into thinking that the toner cartridge is in place, but the seal has been removed. The easiest way to do this is to emulate the electrical signal generated by the cartridge when the cartridge is in place, but the seal has been pulled. Figure Twenty One shows the second end cap 2 in close up and isolation. The various locations on the second end cap are electrical contacts which are in electrical communication with components inside of the toner cartridge 25. The first toner level contact 116, second toner level contact 117, third toner level contact 118, and fourth toner level contact 119 provide information to the printer on toner consumption. The first end cap seal sensor contact 120 is in electrical communication with the seal sensing contact 50A. The second end cap seal sensor contact 121 is in electrical contact with the seal sensing contact 50B. The third end cap seal sensor contact 122 is in electrical communication with seal sensing contact 50C and is the electrical ground. The developer roller end cap contact 123 is in electrical communication with the developer roller. The PCR end cap contact 124 is in electrical communication with the PCR.

By placing an insulative tape over the first end cap seal sensor, a remanufacturer can "trick" the printer into believing that the cartridge is in place, but that the seal has been pulled. This is because the printer senses the presence of the cartridge by seeing an electrical connection between the second end cap seal sensor contact 121 and the third end cap seal sensor contact 122. It senses the presence of the seal by seeing an electrical contact between the first end cap seal sensor contact 120 and the third end cap seal sensor contact 122. When this second connection is broken by placing the insulative tape over the first end cap seal sensor contact 120, the printer believes that the seal has been pulled. The printer thus senses the presence of the cartridge, and that the seal has been pulled. A remanufacturer is now free to print without having the printer activate the spool 51 causing the removal of the seal.

The remanufacturer can place a small amount of toner over the developer roller, place tape over the first end cap seal sensor contact 120 and print several test pages to prove that the cartridge has been properly remanufactured.

We claim:

1. A method of remanufacturing a toner cartridge comprising the steps of:

a) Providing a toner cartridge having a toner hopper, the toner hopper having a toner hopper sealing surface, and a toner discharge opening, a developer roller housing attached to the toner hopper, a waste bin attached to the developer roller housing, the toner hopper, developer roller housing and waste bin together forming a sub assembly, a first end cap attached to one end of the sub assembly, by and along a first end cap weld, a second end cap attached to the second end of the sub assembly, by and along a second end cap weld said second end cap having second end cap conductors below the second end cap welds, the first end cap having first end cap electrical contacts and first end cap posts, the second end cap having second end cap electrical contacts and second end cap posts, a toner cartridge seal, a seal spool, and seal electrical contacts, b) Cutting the first end cap from the sub assembly, c) Cutting the second end cap from the sub assembly, d) Removing the first and second end caps from the sub assembly, e) Separating the waste bin from the developer roller housing, f) Separating the toner hopper from the developer roller housing, g) Removing the existing seal assembly, h) Placing a new seal assembly on the toner hopper sealing surface, i) Reattaching the developer roller housing to the toner hopper, j) Reattaching the waste bin to the developer roller housing, k) Reattaching the first and second end caps to the sub assembly.

2. A method as in claim 1, wherein the steps of cutting second end cap from the subassembly comprises placing the toner cartridge in a toner cartridge splitter, said toner cartridge splitter having a second end cap template configured to fit the second end cap said second end cap template having second template openings, and cutting the second end cap from the subassembly by making a cut through the second template openings.

3. A method as in claim 1, wherein the steps of cutting the first end cap from the sub assembly and cutting the second end cap from the subassembly comprises placing the toner cartridge in a toner cartridge splitter, said toner cartridge splitter having a first template configured to fit the first end cap, said first template having first template openings, second end cap template configured to fit the second end cap said second end cap template having second template openings, and cutting the first end cap from the sub assembly by making a cut through the first template openings, cutting the second end cap from the sub assembly by making a cut through the second template openings.

4. A method as in claim 3 wherein the first template openings are located over the first end cap welds when the first template is placed over the first end cap, and wherein the second template openings are located over the second end cap welds when the second template is placed over the second end cap.

5. A method as in claim 4 wherein the first template of the toner cartridge splitter further comprises a first template axle and the second template of the toner cartridge splitter further comprises a second template axle.

6. A method as in claim 4 wherein the toner cartridge splitter further comprises a first upright with a first template axle holder, and a second upright with a second upright axle holder, and wherein the steps of cutting the first end cap from the sub assembly, and cutting the second end cap from the sub assembly comprises the steps of placing the first template axle in the first template axle holder, and placing the second template axle in the second template axle holder and cutting the first end cap welds through the first template openings, and the second end cap welds through the second template openings.

7. A method as in claim 2 wherein the depth of cut in the second end cap does not contact the second end cap conductors.

8. A method as in claim 5 wherein the depth of cut through the first end cap welds and the second end cap welds is approximately 0.090 inches.

9. A method as in claim 3 wherein the step of placing the toner cartridge into the first and second templates further comprises the step of snugging the first template against the first end cap, and the snugging the second template against the second end cap.

10. A method as in claim 9 wherein the steps of snugging the first and second templates against the first and second end caps comprises the step of attaching at least one strap connecting the first and second templates.

11. A method as in claim 1 wherein the step of reattaching the first end cap and second end cap to the sub assembly comprises attaching a clip between the first end cap and the sub assembly, and a clip between the second end cap and the sub assembly.

12. A method as in claim 11 further comprising steps of attaching additional clips.

13. A method as in claim 11 wherein the clips comprise an end cap post mating section configured for attaching to the first end cap post, and the second end cap post, a post clip base of sufficient length to reach from the first end cap post to the first end cap welds, and a post clip engaging end configured to attach to the end cap weld.

14. A method as in claim 11 wherein the step of attaching a clip comprises providing a screw clip with a screw clip hole, a screw clip base, and a screw clip engaging end, aligning the screw clip engaging end over the first or second end cap welds, engaging the screw clip engaging end over the first or second end cap welds onto the sub assembly, aligning the screw clip hole over a portion of the first or second end cap, attaching a screw through the screw clip hole and into the first or second end cap thus attaching the screw clip to the first or second end cap.

15. A method as in claim 14 further comprising the step of prelocating the place on the end cap for attaching the screw by using a screw clip template having a body, a slide slidably attached to the body, said slide capable of being moved in two directions, a stop on the slide that contact the body at when the slide is extended to a pilot hole on the slide, and predrilling holes through the pilot hole when the stop is in contact with the body of the screw clip template.

16. A method as in claim 1 wherein the step of placing a new seal over the toner hopper sealing surface comprises providing a new seal assembly with a first gasket with a first side, a second side, and a gasket opening, a removable seal layer with a first side and a second side, and a first end and a second end, the first side of the removable seal layer being attached to the second side of the first gasket, said removable seal layer covering the gasket opening, a tail of the removable seal attached to the second end of the removable seal, an electrically conductive trace attached to the second side of the removable seal at the second end of the removable seal, a second gasket with a first side and a second side and a first end and a second end, said first side of the second gasket being attached to the second side of the first gasket except at the second end of the second gasket, said tail of the removable seal being folded over the removable seal, and under the second end of the second gasket, Placing the tail of the removable seal into the spool, Attaching the first side of the first gasket to the toner hopper sealing surface, Placing the electrical conductive traces in contact with the seal sensing sensors, Attaching the second side of the second gasket to the developer roller housing.

17. A method as in claim 16 wherein the step of attaching the first side of the first gasket to the toner hopper sealing surface comprises gluing the first side of the first gasket to the toner hopper sealing surface.

18. A method as in claim 16 wherein the step of attaching the first side of the first gasket to the toner hopper sealing surface comprises providing a new seal assembly further comprising a layer of pressure sensitive adhesive attached to the first side of the first gasket.

19. A method as in claim 16 wherein the step of attaching the second side of the second gasket to the developer roller housing comprises gluing the second side of the second gasket to the developer roller housing.

20. A method as in claim 16 wherein the step of attaching the second side of the second gasket to the developer roller housing comprises further providing the seal assembly with a layer of pressure sensitive adhesive attached to a the second side of the second gasket.

21. A method as in claim 16 wherein the electrically conductive trace comprises three layers, a conductive layer, an adhesive layer attached to the conductive layer, and an insulative non-conductive layer attached to the adhesive layer, said conductive layer having a portion of the conductive layer removed creating two electrically conductive paths through the conductive layer and having a tear line that passes through the first of the electrically conductive paths.

22. A method as in claim 16 wherein the new seal assembly further comprises a lubricating layer attached to the first side of the second gasket at the first end to facilitate the removal of the removable seal.

23. A method as in claim 1 further comprising the step of testing the print quality of the remanufactured toner cartridge after reattaching the first and second end caps to the sub assembly.

24. A method as in claim 23 wherein the step of testing the print quality comprises the steps of covering the first end cap sensor with a nonconductive material, placing a bead of toner on the developer roller, placing the remanufactured toner cartridge in the printer, and printing test pages.

25. A method of remanufacturing a toner cartridge comprising the steps of:

Providing a toner cartridge having a toner hopper, the toner hopper having a toner hopper sealing surface, and a toner discharge opening, a developer roller housing attached to the toner hopper, a waste bin attached to the developer roller housing, the toner hopper, developer roller housing and waste bin together forming a sub assembly, a first end cap attached to one end of the sub assembly by and along a first end cap weld, a second end cap attached to the second end of the sub assembly, by and along a second end cap weld said second end cap having second end cap conductors below the second end cap welds, the first end cap having first end cap electrical contacts and first end cap posts, the second end cap having second end cap electrical contacts and second end cap posts, a toner cartridge seal, a seal spool, and seal electrical contacts, Cutting the first end cap from the sub assembly, Cutting the second end cap from the sub assembly, Removing the first and second end caps from the sub assembly, Separating the waste bin from the developer roller housing, Separating the toner hopper from the developer roller housing, Removing the existing seal assembly, Placing a new seal assembly on the toner hopper sealing surface, Reattaching the developer roller housing to the toner hopper, Reattaching the waste bin to the developer roller housing, Providing a new first end cap and new second end cap, Attaching the new first and second end caps to the sub assembly.

26. A method of remanufacturing a toner cartridge comprising the steps of:

Providing a toner cartridge having a toner hopper, the toner hopper having a toner hopper sealing surface, and a toner discharge opening, a developer roller housing attached to the toner hopper, a waste bin attached to the developer roller housing, the toner hopper, developer roller housing and waste bin together forming a sub assembly, a first end cap attached to one end of the sub assembly by and along a first end cap weld, a second end cap attached to the second end of the sub assembly, by and along a second end cap weld said second end cap having second end cap conductors below the second end cap welds, the first end cap having first end cap electrical contacts and first end cap posts, the second end cap having second end cap electrical contacts and second end cap posts, a toner cartridge seal, a seal spool, and seal electrical contacts, Cutting the first end cap from the sub assembly, Cutting the second end cap from the sub assembly, Removing the first and second end caps from the sub assembly, Separating the waste bin from the developer roller housing, Separating the toner hopper from the developer roller housing, Removing the existing seal assembly, Placing a new seal assembly on the toner hopper sealing surface, Reattaching the developer roller housing to the toner hopper, Reattaching the waste bin to the developer roller housing, Providing a new first end cap, Attaching the new first end cap and old second end cap to the sub assembly.

27. A method of remanufacturing a toner cartridge comprising the steps of:

Providing a toner cartridge having a toner hopper, the toner hopper having a toner hopper sealing surface, and a toner discharge opening, a developer roller housing attached to the toner hopper, a waste bin attached to the developer roller housing, the toner hopper, developer roller housing and waste bin together forming a sub assembly, a first end cap attached to one end of the sub assembly by and along a first end cap weld, a second end cap attached to the second end of the sub assembly, by and along a second end cap weld said second end cap having second end cap conductors below the second end cap welds, the first end cap having first end cap electrical contacts and first end cap posts, the second end cap having second end cap electrical contacts and second end cap posts, a toner cartridge seal, a seal spool, and seal electrical contacts, Cutting the first end cap from the sub assembly, Cutting the second end cap from the sub assembly, Removing the first and second end caps from the sub assembly, Separating the waste bin from the developer roller housing, Separating the toner hopper from the developer roller housing, Removing the existing seal assembly, Placing a new seal assembly on the toner hopper sealing surface, Reattaching the developer roller housing to the toner hopper, Reattaching the waste bin to the developer roller housing, Providing a new second end cap, Attaching the old first end cap and new second end cap to the sub assembly.

* * * * *